US009523950B1

(12) United States Patent
Tamemasa et al.

(10) Patent No.: US 9,523,950 B1
(45) Date of Patent: Dec. 20, 2016

(54) HEATING DEVICE, FIXING DEVICE, IMAGE FORMING APPARATUS, AND BASE MATERIAL FOR HEATING DEVICE

(71) Applicant: FUJI XEROX CO., LTD., Tokyo (JP)

(72) Inventors: Hiroshi Tamemasa, Kanagawa (JP); Tohru Inoue, Kanagawa (JP); Takashi Ohashi, Kanagawa (JP); Jumpei Amano, Kanagawa (JP); Kiyoshi Koyanagi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/052,199

(22) Filed: Feb. 24, 2016

(30) Foreign Application Priority Data

Jul. 8, 2015 (JP) ..... 2015-137161

(51) Int. Cl.
*G03G 15/20* (2006.01)

(52) U.S. Cl.
CPC ..... *G03G 15/206* (2013.01)

(58) Field of Classification Search
CPC ..... G03G 15/206; G03G 15/2053; G03G 15/2057
See application file for complete search history.

(56) References Cited

U.S. PATENT DOCUMENTS 6,958,645 B2 10/2005 Okabayashi
8,761,621 B2 6/2014 Sakai
9,037,054 B2 5/2015 Mukai
2009/0245900 A1* 10/2009 Kagawa ..... G03G 15/2042 399/329
2009/0263171 A1* 10/2009 Kageyama ..... G03G 15/2053 399/329
2014/0076878 A1* 3/2014 Shimura ..... G03G 15/2042 219/216

FOREIGN PATENT DOCUMENTS

JP 2003-287970 A 10/2003
JP 2012-159865 A 8/2012
JP 2013-011649 A 1/2013
JP 2013-024890 A 2/2013
JP 2013-073207 A 4/2013
JP 2013-182025 A 9/2013
JP 2013-186403 A 9/2013

* cited by examiner

*Primary Examiner* — Sandra Brase
(74) *Attorney, Agent, or Firm* — Sughrue Mion, PLLC

(57) ABSTRACT

A heating device includes a belt member that is rotated, plural heating elements that are arranged in a width direction of the belt member and generate heat so as to heat the belt member, plural resistance elements that have positive temperature coefficients and are connected to the plural heating elements such that each of the plural resistance elements is connected in series with a corresponding one of the plural heating elements, and a base material that includes a heat-conductive metal layer and a pair of heat-resistant metal layers between which the heat-conductive metal layer is interposed and has a surface on which the plural heating elements and the plural resistance elements are disposed. A temperature of the belt member is reduced by an increase in resistances of the plural resistance elements caused by an increase in temperatures of the plural resistance elements.

17 Claims, 13 Drawing Sheets

HEATING DEVICE, FIXING DEVICE, IMAGE FORMING APPARATUS, AND BASE MATERIAL FOR HEATING DEVICE

CROSS-REFERENCE TO RELATED APPLICATIONS

This application is based on and claims priority under 35 USC 119 from Japanese Patent Application No. 2015-137161 filed Jul. 8, 2015.

BACKGROUND

Technical Field

The present invention relates to a heating device, a fixing device, an image forming apparatus, and a base material for a heating device.

SUMMARY

According to an aspect of the present invention, a heating device includes a belt member that is rotated, plural heating elements that are arranged in a width direction of the belt member and that generate heat so as to heat the belt member, plural resistance elements that have positive temperature coefficients and that are connected to the plural heating elements such that each of the plural resistance elements is connected in series with a corresponding one of the plural heating elements, and a base material that includes a heat-conductive metal layer and a pair of heat-resistant metal layers between which the heat-conductive metal layer is interposed and that has a surface on which the plural heating elements and the plural resistance elements are disposed. A temperature of the belt member is reduced by an increase in resistances of the plural resistance elements caused by an increase in temperatures of the plural resistance elements.

BRIEF DESCRIPTION OF THE DRAWINGS

Exemplary embodiments of the present invention will be described in detail based on the following figures, wherein.

DETAILED DESCRIPTION

An exemplary embodiment of the present invention will be described below with reference to the accompanying drawings.

Description of an Image Forming Apparatus

Figure 1:
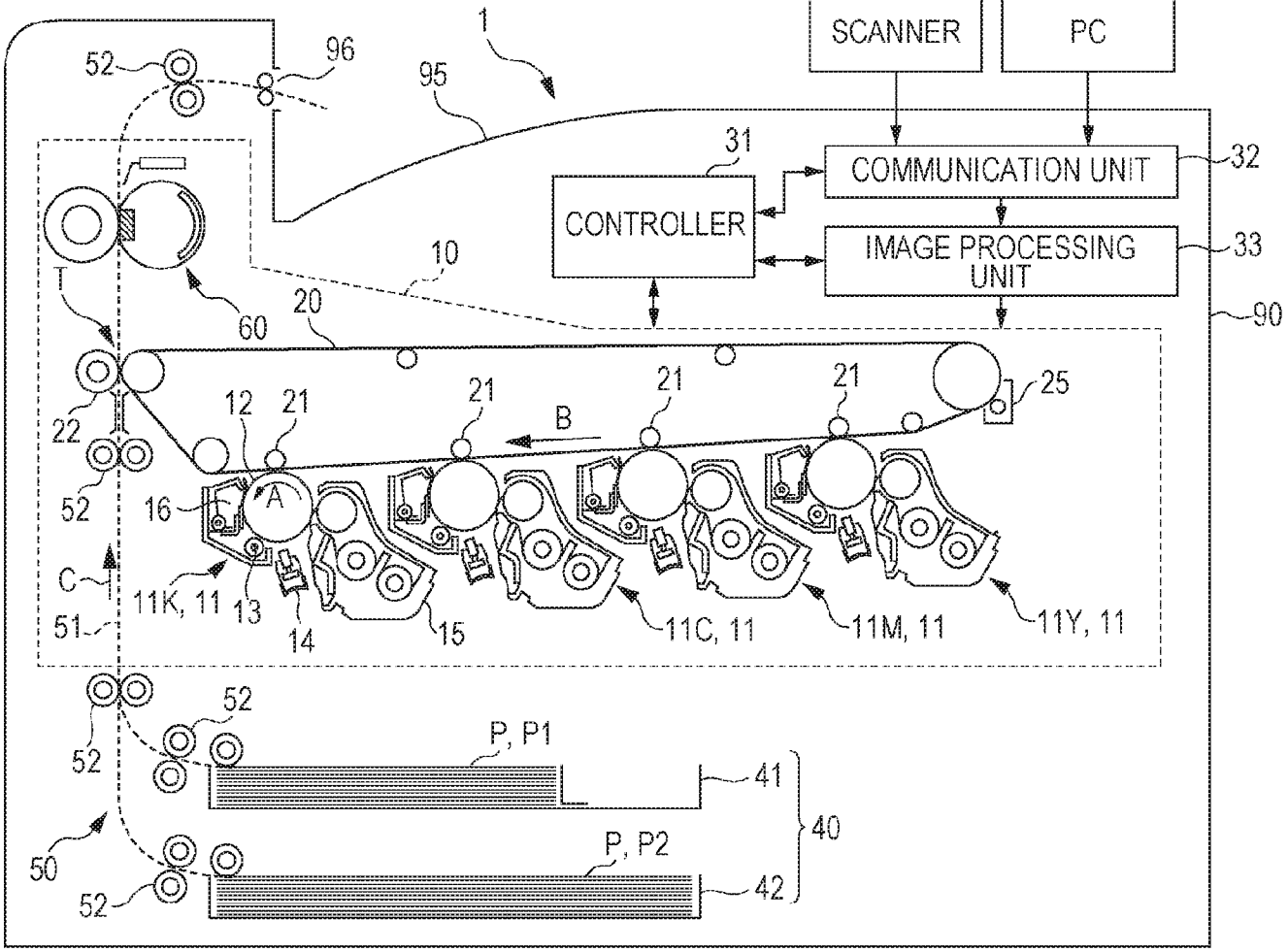
FIG. 1 is a schematic sectional view illustrating an image forming apparatus according to an exemplary embodiment of the present invention.

FIG. 1 is a schematic sectional view illustrating an image forming apparatus 1 according to the exemplary embodiment of the present invention.

The image forming apparatus 1 illustrated in FIG. 1 is an electrophotographic laser color printer that prints images in accordance with image data and serves as an example of an image forming apparatus of the present invention.

As illustrated in FIG. 1, this image forming apparatus 1 includes a sheet containing unit 40, an image forming section 10, and a transport unit 50 housed in a body casing 90. The sheet containing unit 40 contains sheets of paper P (serving as an example of recording media). The image forming section 10 forms images on the sheets P. The transport unit 50 transports the sheets P from the sheet containing unit 40 to a sheet output opening 96 of the body casing 90 through the image forming section 10. The image forming apparatus 1 also includes a controller 31, a communication unit 32, and an image processing unit 33. The controller 31 controls operations of the entirety of the image forming apparatus 1. The communication unit 32 performs communication with, for example, a personal computer (PC)

3 or an image reading device (scanner) 4 to receive image data. The image processing unit 33 performs image processing on the image data received by the communication unit 32.

The sheet containing unit 40 includes a first sheet container 41 and a second sheet container 42 that each contain a corresponding one of two types of sheets of paper (an example of recording media). The sizes of two types of the sheets are different from each other. The first sheet container 41 contains sheets P1, which are, for example, A4 size sheets. The second sheet container 42 contains sheets P2, which are, for example, B4 size sheets. The "sheets P" may generally refer to the sheets P1 and the sheets P2 hereafter. Also, the sheets P, the sheets P1 and the sheets P2 may be referred to in their respective singular forms "sheet P", "sheet P1" and "sheet P2" when, for example, a single sheet out of the sheets P, a single sheet out of the sheets P1, and a single sheet out of the sheets P2 are described hereafter. The transport unit 50 includes a transport path 51 for the sheets P and transport rollers 52. The transport path 51 extends from the first sheet container 41 and the second sheet container 42 to the sheet output opening 96 through the image forming section 10. The transport rollers 52 transport the sheets P along the transport path 51. The sheets P1 and P2 transported by the transport unit 50 assume, when transported in an arrow C direction along the transport path 51, a position in which the longitudinal directions thereof extend in the arrow C direction which is a feeding direction of the sheets P1 and P2.

The image forming section 10 includes four image forming units 11Y, 11M, 11C, and 11K. The image forming units 11Y, 11M, 11C, and 11K are arranged at predetermined intervals. The image forming units 11Y, 11M, 11C, and 11K may be generally referred to as the "image forming units 11" hereafter. The image forming units 11 each include a photosensitive drum 12, a charger 13, a print head 14, a developing device 15, and a drum cleaner 16. The photosensitive drum 12 allows an electrostatic latent image to be formed thereon so as to hold a toner image. A surface of the photosensitive drum 12 is charged to a predetermined potential with the charger 13. The print head 14 uses a light emitting diode (LED) and radiates light in accordance with image data for a corresponding one of colors to the photosensitive drum 12 having been charged with the charger 13. The developing device develops the electrostatic latent image formed on the surface of the photosensitive drum 12. The drum cleaner 16 cleans the surface of the photosensitive drum 12 after transfer.

Four image forming units 11Y, 11M, 11C, and 11K have similar or the same structures except for toner contained in the developing devices 15. The image forming unit 11Y, which includes the developing device 15 containing yellow (Y) toner, forms a yellow toner image. Likewise, the image forming unit 11M, which includes the developing device 15 containing magenta (M) toner, forms a magenta toner image, the image forming unit 11C, which includes the developing device 15 containing cyan (C) toner, forms a cyan toner image, and the image forming unit 11K, which includes the developing device 15 containing black (K) toner, forms a black toner image.

The image forming section 10 further includes an intermediate transfer belt 20 and first transfer rollers 21. The toner images of the colors formed on the photosensitive drums 12 of the respective image forming units 11 are subjected to multi-transfer onto the intermediate transfer belt 20 performed by superposing these toner images on one another on the intermediate transfer belt 20. The first transfer rollers 21 perform sequential electrostatic transfer (first transfer) of the toner images of the colors formed by the respective image forming units 11 onto the intermediate transfer belt 20. The image forming section 10 further includes a second transfer roller 22 of a second transfer unit T and a fixing unit 60 (an example of a fixing device). The second transfer roller 22 performs collective electrostatic transfer (second transfer) of the superposed toner images onto the sheet P. These superposed toner images are formed by transferring the toner images of the colors onto the surface of the intermediate transfer belt 20 so as to be superposed on one another. The fixing unit 60 fixes the superposed toner images having been transferred onto the sheet P through second transfer.

The image forming apparatus 1 performs image forming processing through the following processes under control of the controller 31. That is, image data transmitted from the PC 3 or the scanner 4 is received by the communication unit 32 and subjected to predetermined image processing performed by the image processing unit 33. After that, the image data is changed into color image data for the respective colors and transmitted to the image forming units 11 of the corresponding colors. For example, in the image forming unit 11K that forms a black toner image, the photosensitive drum 12 is charged to the predetermined potential with the charger 13 while being rotated in an arrow A direction.

After that, the print head 14 radiates the light to the photosensitive drum 12 so as to scan the photosensitive drum 12 in accordance with the black image data transmitted from the image processing unit 33. Thus, a black electrostatic latent image corresponding to the black image data is formed on the surface of the photosensitive drum 12. The black electrostatic latent image formed on the photosensitive drum 12 is developed by the developing device 15. Thus, the black toner image is formed on the photosensitive drum 12. Likewise, yellow, magenta, and cyan toner images are respectively formed by the image forming units 11Y, 11M, and 11C.

The toner images of the colors formed on the photosensitive drums 12 of the respective image forming units 11 are sequentially transferred through electrostatic transfer onto the intermediate transfer belt 20 that is being moved in an arrow B direction by the first transfer rollers 21. Thus, the superposed toner images formed of the toner images of the colors superposed on one another are formed on the intermediate transfer belt 20.

By moving the intermediate transfer belt 20 in the arrow B direction, the superposed toner images on the intermediate transfer belt 20 are moved to the second transfer unit T. When the superposed toner images are moved to the second transfer unit T, the sheet P in the sheet containing unit 40 is transported along the transport path 51 in the arrow C direction by the transport rollers 52 of the transport unit 50 at timing adjusted to timing at which the superposed toner images are moved. The superposed toner images formed on the intermediate transfer belt 20 are collectively transferred through electrostatic transfer onto the sheet P having been transported along the transport path 51. The electrostatic transfer is caused by a transfer electric field generated by the second transfer roller 22 in the second transfer unit T.

After that, the sheet P onto which the superposed toner images have been transferred through electrostatic transfer is transported to the fixing unit 60 along the transport path 51. The superposed toner images on the sheet P having been transported to the fixing unit 60 are subjected to heat and pressure applied by the fixing unit 60, thereby being fixed onto the sheet P. Then, the sheet P on which the fixed superposed toner images are formed is output through the sheet output opening 96 of the body casing 90 along the transport path 51 and stacked on a sheet stacking unit 95 on which the sheets P are placed.

Meanwhile, toner remaining on the photosensitive drums 12 after the first transfer and toner remaining on the intermediate transfer belt 20 after the second transfer are respectively removed by the drum cleaner 16 and a belt cleaner 25.

Processing of printing an image on the sheet P is repeatedly performed by the image forming apparatus 1 the number of cycles corresponding to the number of prints.

Description of the Fixing Unit

Figure 2:
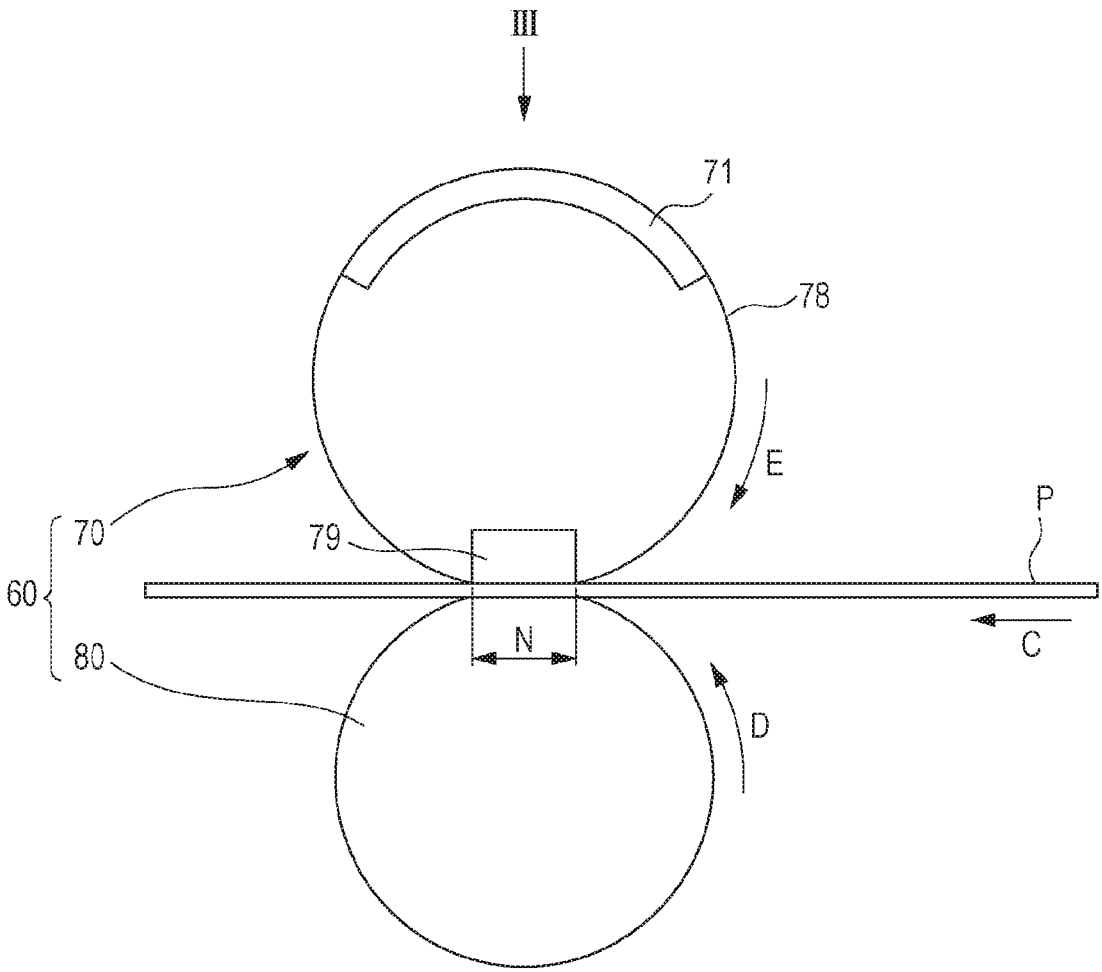
FIG. 2 is a sectional view illustrating the details of a fixing unit of the image forming apparatus.

FIG. 2 is a sectional view illustrating the details of the fixing unit 60 of the image forming apparatus 1.

The fixing unit 60 illustrated in FIG. 2 includes a heater unit 70 (an example of a heating device) and a pressure roller 80 (an example of a pressure member). The heater unit 70 and the pressure roller 80 have respective cylindrical shapes. Both the axes of the heater unit 70 and the pressure roller 80 extend in the depth direction of the page of FIG. 2.

As illustrated in FIG. 2, the heater unit 70 includes a rotating fixing belt 78 (an example of a belt member), a solid heater 71, and a pressure pad 79. The solid heater 71 having an arc-shaped section generates heat. The pressure pad 79 is pressed by the pressure roller 80 through the fixing belt 78.

The original shape of the fixing belt 78 is an endless cylindrical shape. The fixing belt 78 is disposed such that an inner circumferential surface of the fixing belt 78 is in contact with an outer circumferential surface of the solid heater 71 and the pressure pad 79. The fixing belt 78 is heated through its contact with the solid heater 71.

The pressure roller 80 is in pressure contact with an outer circumferential surface of the fixing belt 78, thereby forming a nip portion N therebetween. Each of the sheets P holding unfixed superposed toner images passes through the nip portion N. The pressure roller 80 is rotated in an arrow D direction by a drive device, which is omitted from FIG. 2.

The sheet P transported to the nip portion N by the transport unit 50 (see FIG. 1) is heated by the fixing belt 78 and subjected to pressure applied by the pressure roller 80 and the pressure pad 79 through the fixing belt 78 in the nip portion N. Thus, the unfixed superposed toner images held by the sheet P are fixed onto the sheet P.

In the nip portion N, the sheet P in contact with the pressure roller 80 is fed in the arrow C direction by rotation of the pressure roller 80 in an arrow D direction. The fixing belt 78 in contact with the sheet P follows the movement of the sheet P, thereby rotating in an arrow E direction (rotating direction).

Description of the Solid Heater

Figure 3:
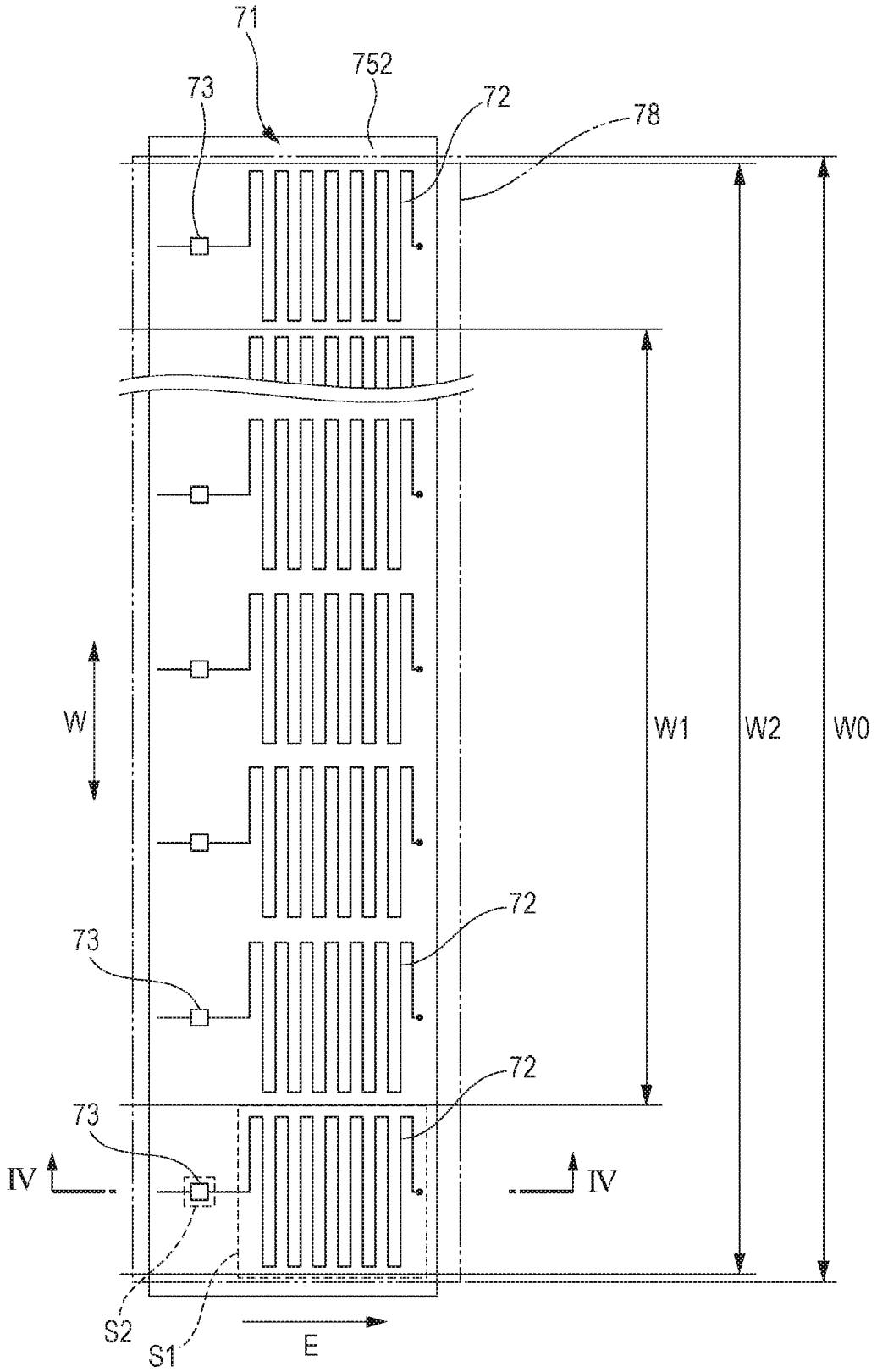
FIG. 3 illustrates a solid heater illustrated in FIG. 2 seen in an arrow III direction illustrated in FIG. 2.
Figure 4:
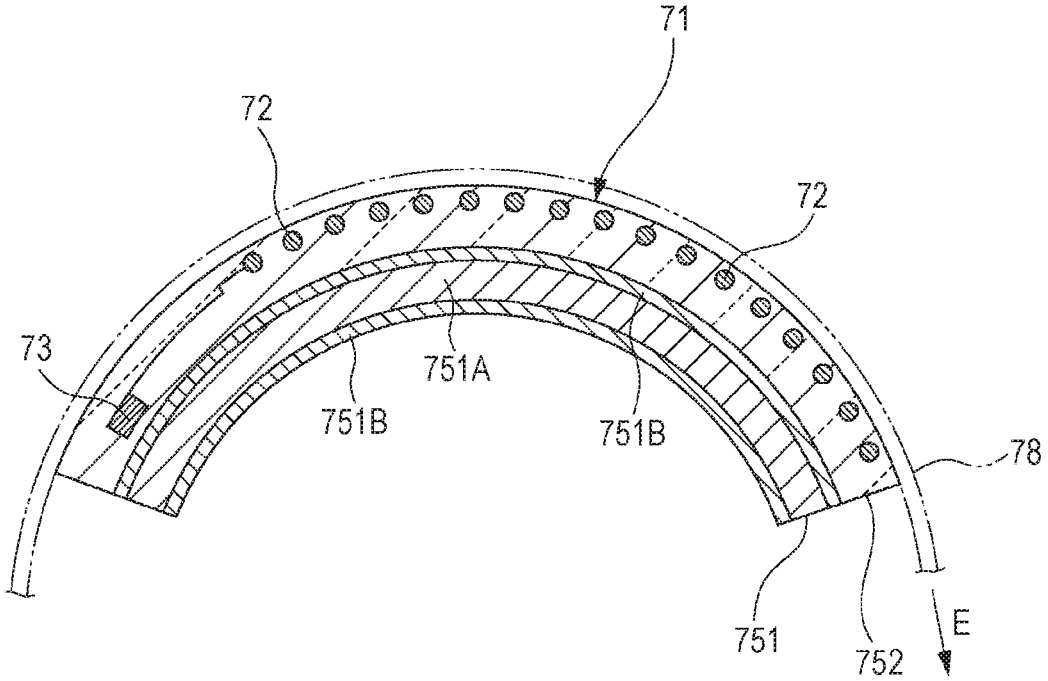
FIG. 4 is a sectional view of the solid heater taken along line IV-IV illustrated in FIG. 3.
Figure 5:
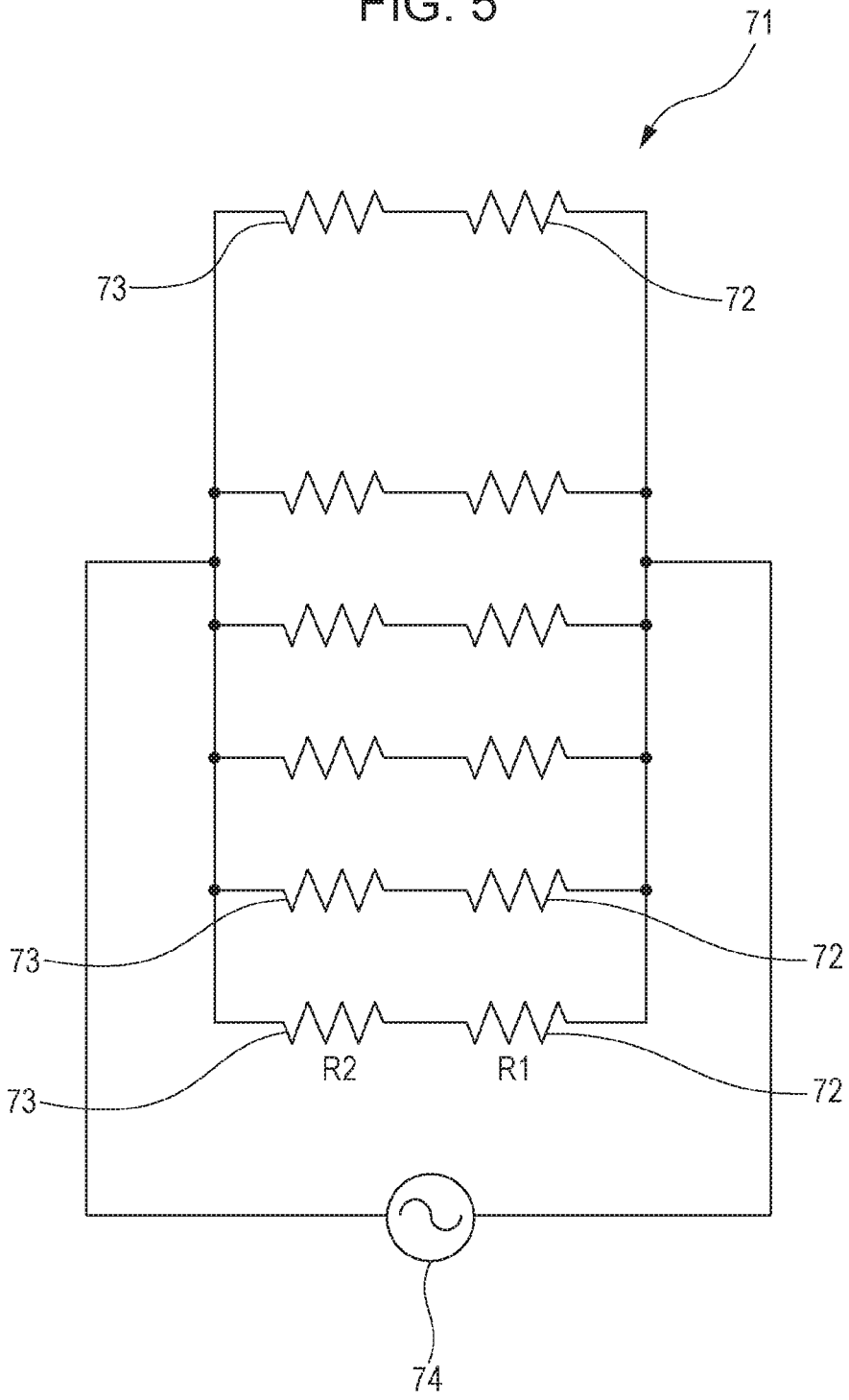
FIG. 5 illustrates an electrical circuit of the solid heater.

FIG. 3 illustrates the solid heater 71 seen in an arrow III direction illustrated in FIG. 2. FIG. 4 is a sectional view taken along line IV-IV illustrated in FIG. 3. FIG. 5 illustrates an electrical circuit of the solid heater 71. As illustrated in FIGS. 3 and 4, the solid heater 71 includes resistance heating elements 72 (each serving as an example of a heating element), positive temperature coefficient (PTC) elements 73 (each serving as an example of a resistance element having a positive temperature coefficient), and a base material 751. The PTC elements 73 are formed of a material such as, for example, barium titanate. The resistance heating elements 72 and the PTC elements 73 are disposed on a surface of the base material 751. The resistance heating elements 72 and the PTC elements 73 are disposed on the base material 751 while being supported by (embedded in) a glass coat 752.

Specifically, the base material 751 extends in a width direction W of the fixing belt 78 and has an arc-shaped section as illustrated in FIG. 4. The glass coat 752 that supports the resistance heating elements 72 and the PTC elements 73 is stacked on a radially outer side of the base material 751.

The fixing belt 78 is looped over an outer circumferential surface of the glass coat 752 and rotated forward in the arrow E direction while being in contact with the glass coat 752.

As illustrated in FIG. 3, the plural resistance heating elements 72 and the plural PTC elements 73 are arranged in a direction in which the solid heater 71 extends (hereafter referred to as a longitudinal direction that is coincident with a direction along the width direction W of the fixing belt 78).

Each of the resistance heating elements 72 generates heat when power is supplied thereto. Each of the plural PTC elements 73 is, as illustrated in FIG. 5, connected in series to a corresponding one of the resistance heating elements 72. As illustrated in FIG. 3, the PTC elements 73 are disposed upstream of the resistance heating elements 72 in the arrow E direction, which is the fixing belt 78 rotating direction.

Each of the resistance heating elements 72 and a corresponding one of the PTC elements 73 connected in series with each other form an element set, and the element sets are arranged in the longitudinal direction of the solid heater 71. As illustrated in FIG. 5, the element sets are connected in parallel with a power source 74.

Figure 6:
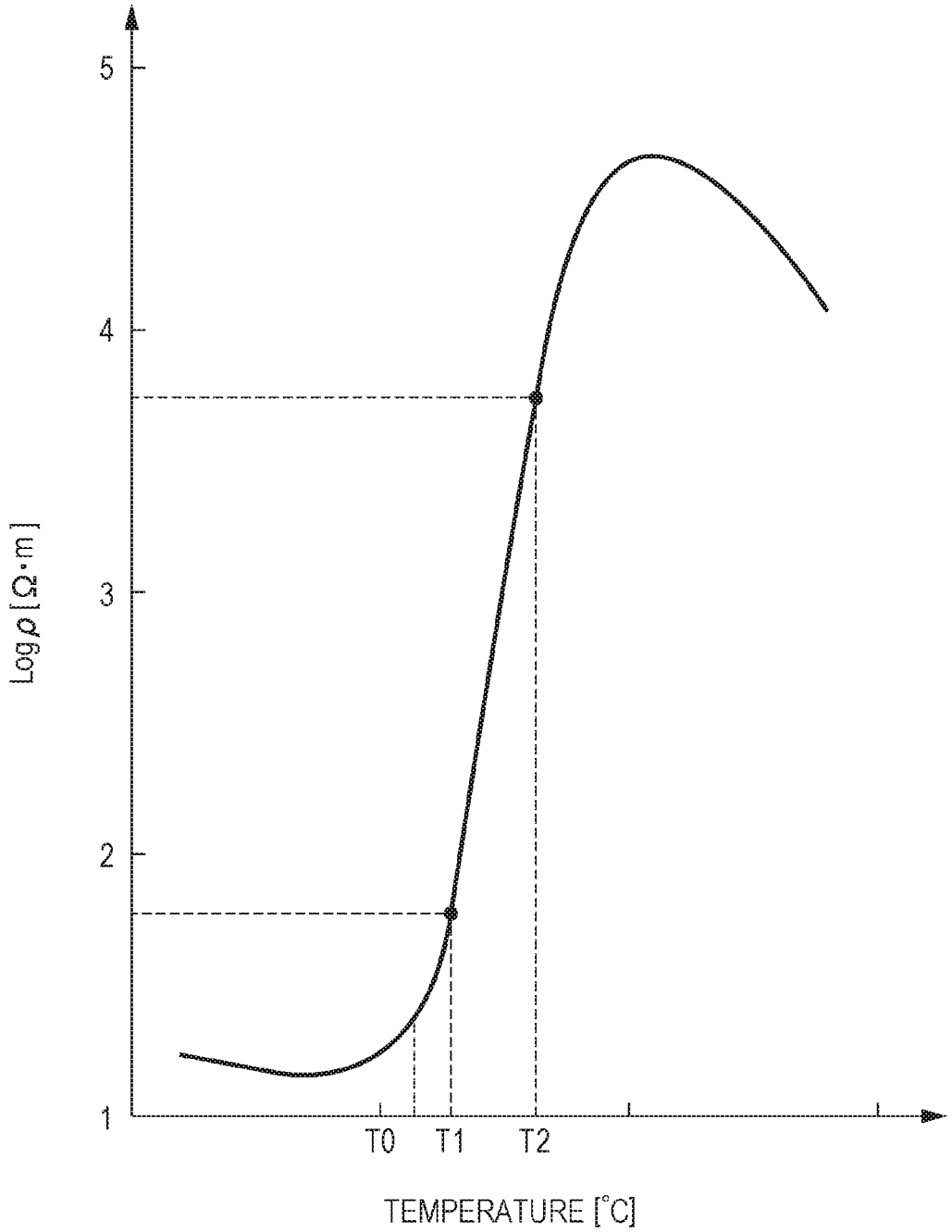
FIG. 6 is a characteristic chart illustrating the relationship between the temperature and the resistivity of PTC elements.

FIG. 6 is a characteristic chart illustrating the relationship between the temperature and the resistivity of the PTC elements 73.

As illustrated in FIG. 6, the PTC elements 73 exhibit a characteristic having a positive temperature coefficient by which the resistivity steeply increases compared to a resistor formed of an ordinary metal material or the like at a temperature higher than the Curie temperature T0 degrees.

At a temperature lower than the Curie temperature T0 degrees (see FIG. 6), that is, at a so-called ordinary environmental temperature, a resistance R2 (see FIG. 5) of the PTC elements 73 is set to about one hundredth of the resistance R1 of the resistance heating elements 72. It is also set that, while the temperature of the PTC elements 73 increases from temperature T1 degrees exceeding the Curie temperature T0 degrees to temperature T2 degrees, the resistance R2 of the PTC elements 73 becomes from 20 to 100 times the resistance R1 of the resistance heating elements 72 after the resistance R2 has steeply increased.

The plural resistance heating elements 72 of the solid heater 71 are arranged in the longitudinal direction of the solid heater 71 in the outer circumferential surface of the glass coat 752 in contact with the fixing belt 78. As illustrated in FIG. 3, the width of the resistance heating elements 72 in the longitudinal direction is set to such a degree that the resistance heating elements 72 adjacent to one another are close to one another. Each of the PTC elements 73 is a very small chip having dimensions of, for example, about 2 mm in length×2 mm in width×0.1 mm in thickness.

Thus, the PTC elements 73 adjacent to one another are separated from one another by a distance greater than the distance between the adjacent resistance heating elements 72.

Thus, as illustrated in FIG. 3, in the outer circumferential surface of the glass coat 752 in contact with the fixing belt 78, the PTC elements 73 are disposed in and occupy respective regions S2 (serving as regions where the plural resistance elements are disposed), the resistance heating elements 72 are disposed in and occupy respective regions S1 (serving as regions where the plural heating elements are disposed), and each of the regions S2 is smaller than a corresponding one of the regions S1.

Here, the relationships between the arrangement of the resistance heating elements 72 of the solid heater 71, the fixing belt 78 heated by the solid heater 71, and the widths W1 and W2 of the sheets P1 and P2 onto which the superposed toner images are fixed by the fixing unit 60 (see FIG. 2) are described. The fixing belt 78 is slightly shorter than the entire length of the solid heater 71 in the longitudinal direction. This allows the fixing belt 78 to be heated to a substantially uniform temperature over an entire width W0 in the width direction W by the plural resistance heating elements 72 provided in the solid heater 71.

The width W2 (length in the width direction W) of the B4 sheets P2, which are large sheets out of the sheets P subjected to fixing in the nip portion N of the fixing unit 60, is, as illustrated in FIG. 3, about a length slightly shorter than the entire width W0 of the fixing belt 78 and corresponds to a length that extends across all the resistance heating elements 72 of the solid heater 71.

The width W1 (length in the width direction W) of the A4 sheets P1, which are small sheets out of the sheets P subjected to fixing in the nip portion N of the fixing unit 60, is, as illustrated in FIG. 3, a length shorter than the entire width W0 of the fixing belt 78 and corresponds to a length that does not reach two resistance heating elements 72 arranged at both ends out of the resistance heating elements 72 arranged in the longitudinal direction of the solid heater 71.

That is, out of the resistance heating elements 72 arranged in the longitudinal direction illustrated in FIG. 3, the resistance heating element 72 arranged at each end corresponds to a non-sheet-pass-through range (non-pass-through range) where the sheet P1 does not pass through when the A4 sheet P1 is subjected to fixing.

Here, the resistance heating elements 72 and the PTC elements 73 are enclosed by the glass coat 752 stacked on the base material 751. The glass coat 752 insulates the resistance heating elements 72 and the PTC elements 73 from the fixing belt 78. In this solid heater 71, a different insulating material may be used instead of the glass coat 752.

The base material 751 is a so-called clad base material that includes a heat-conductive metal layer 751A and a pair of heat-resistant metal layers 751B between which the heat-conductive metal layer 751A is interposed.

The heat-conductive metal layer 751A is a metal layer that has a higher heat conductivity and a lower heat resistance (resistance against oxidation due to application of heat) than those of the heat-resistant metal layers 751B. Specifically, the heat conductivity of the heat-conductive metal layer 751A is 100 W/mK or more. The weight increase rate per unit area of the heat-conductive metal layer 751A is 1.0 $mg/cm^2$ or more when being subjected to heat treatment for one hour at 500° C. in an air atmosphere.

The heat-resistant metal layers 751B are metal layers that have a lower heat conductivity and a higher heat resistance (resistance against oxidation due to application of heat) than those of the heat-conductive metal layer 751A. Specifically, the heat conductivity of the heat-resistant metal layers 751B is less than 100 W/mK. The weight increase rate per unit area of the heat-resistant metal layers 751B is less than 1.0 $mg/cm^2$ when being subjected to heat treatment for one hour at 500° C. in an air atmosphere.

That is, the base material 751, which includes the heat-resistant metal layers 751B as its outer layers and the heat-conductive metal layer 751A as its inner layer, has a high heat conductivity and a heat resistance with which the oxidation due to repeated heating is not likely to occur. In particular, one of the heat-resistant metal layers 751B serving as one of the outer layers on the resistance heating element 72 and the PTC element 73 side contributes to the heat resistance against repeated heating (resistance against oxidation due to application of heat), and the other heat-resistant metal layer 751B serving as the other outer layer on a side opposite to the resistance heating element 72 and the PTC element 73 side contributes to heat resistance (resistance against oxidation due to application of heat) against heat applied when the resistance heating elements 72, the PTC elements 73, and the glass coat 752 are formed.

It is noted that, in general, a metal having a high heat conductivity tends to have a low heat resistance (resistance against oxidation due to application of heat) and a metal having a high heat resistance (resistance against oxidation due to application of heat) tends to have a low heat conductivity.

The heat conductivity of a metal layer is measured by a laser flash method performed on a target metal layer.

The weight increase rate of a metal layer is calculated by measuring the weight of a target metal layer before and after a heat process in an air atmosphere at 500° C. is performed on the target metal for one hour.

Examples of the heat-conductive metal layer 751A include, for example, a copper layer, an aluminum layer, a silver layer, and a bronze (Cu—Sn) layer. Among these layers, from the viewpoint of improvement of the heat conductivity of the base material, the heat-conductive metal layer 751A is preferably, for example, a copper layer, an aluminum layer, a silver layer, or a bronze (Cu—Sn) layer, and is more preferably a copper layer. Examples of Cu included in the copper layer include Cu, a low oxygen Cu, an oxygen-free Cu, a tough-pitch Cu, a phosphorus deoxidized Cu, and a high purity Cu the purity of which is 99.99% or more.

Examples of each of the heat-resistant metal layers 751B include, for example, a stainless steel layer, a nickel layer, an Ni—Cr layer, and a titanic layer.

It is noted that the ratio of a target metal included in a metal layer is 90% or more by weight (preferably, 95% or more by weight). For example, the rate of copper included in a copper layer is 90% or more by weight (preferably, 95% or more by weight).

From the viewpoint of improvement of the heat conductivity of the base material 751 and improvement of the heat resistance of the base material 751 against heating, the ratio of the layer thickness of each of the pair of heat-resistant metal layers 751B to the layer thickness of the heat-conductive metal layer 751A (layer thickness of each of the pair of heat-resistant metal layers 751B/layer thickness of the heat-conductive metal layer 751A) is preferably from 1/3 to 10/1, more preferably from 1/2 to 8/1, and further more preferably from 1/1 to 6/1.

The layer thickness of the heat-conductive metal layer 751A is measured in the section of the base material having been embedded in the thickness direction.

The base material 751 is fabricated, for example, as follows. A heat-resistant metal sheet that becomes one of the heat-resistant metal layers 751B, a heat-conductive metal sheet that becomes the heat-conductive metal layer 751A, and another heat-resistant metal sheet that becomes the other heat-resistant metal layer 751B are rolled so that these sheets have target thicknesses. After that, these rolled sheets are joined to one another by cold rolling. Next, the joined sheets are heated so as to perform diffusion bonding between the joined sheets. The diffusion bonded sheets are processed by cold rolling so that the diffusion bonded sheets have a target thickness, thereby a clad sheet is obtained. After that, the obtained clad sheet is processed by, for example, press punching, thereby the base material 751 having a target size is obtained.

Description of Operations of the Heater Unit

Next, operations of the heater unit 70 according to the present exemplary embodiment are described.

The solid heater 71 generates heat when a current supplied from the power source 74 passes therethrough as illustrated in FIG. 5. At this time, the temperature of the PTC elements 73 is the Curie temperature T0 degrees or lower under the ordinary environmental temperature. Thus, the resistance R1 of the resistance heating elements 72 connected in series with the respective PTC elements 73 is about 100 times greater than the resistance R2 of the PTC elements 73. Accordingly, the PTC elements 73 consume far smaller amount of power than that consumed by the resistance heating elements 72 and do not generate heat. In contrast, the resistance heating elements 72 generate heat.

The fixing belt 78 is heated entirely in the width direction W by the resistance heating elements 72 through the glass coat 752 (see FIG. 4) at a part thereof looped over the solid heater 71 while being rotated in the arrow E direction as illustrated in FIG. 3. Thus, the temperature of the fixing belt 78 reaches a target temperature required to fix the superposed toner images. When the heated part of the fixing belt 78 is rotated to the nip portion N (see FIG. 2), the heated part of the fixing belt 78 is brought into contact with the sheet P. At this time, the unfixed superposed toner images held by the sheet P are heated by the fixing belt 78 and subjected to a pressure applied by the pressure pad 79 and the pressure roller 80 in the nip portion N. This causes the unfixed superposed toner images held by the sheet P to be fixed onto the sheet P.

Here, in the case where the sheet P having been transported to the nip portion N is the B4 sheet P2, since the sheets P2 have the width W2 that is slightly shorter than the entire width W0 of the fixing belt 78, the entirety of the fixing belt 78 in the width direction W is brought into contact with the sheet P2. Thus, the temperature of the fixing belt 78 is reduced entirely in the width direction W. When the fixing belt 78 is rotated in the arrow E direction, and a part of the fixing belt 78 where the temperature has been reduced returns to the solid heater 71 as illustrated in FIG. 2, this part is heated to the target temperature again by the resistance heating elements 72 through the glass coat 752.

At this time, since the glass coat 752 is cooled by heat exchange with the fixing belt 78, the PTC elements 73 enclosed by the glass coat 752 do not exceed the Curie temperature T0 degrees (see FIG. 6). Accordingly, the heater unit 70 repeats the above-described operations (heat exchange between the glass coat 752 and the fixing belt 78 (heating the fixing belt 78 and reducing the temperature of the glass coat 752), heat exchange between the fixing belt 78 and the sheet P2 (reducing the temperature of the fixing belt 78), and heat exchange between the fixing belt 78 and the glass coat 752).

It is noted that when the PTC elements 73 are disposed upstream of the resistance heating elements 72 in the rotating direction of the fixing belt 78 (arrow E direction) in the solid heater 71, the temperature-reduced part of the fixing belt 78 at a stage before heated by the resistance heating elements 72 is brought into contact with the PTC elements 73 through the glass coat 752. Thus, the PTC elements 73 are also cooled by heat exchange with the fixing belt 78. This may reduce the likelihood of the temperature of the PTC elements 73 reaching the Curie temperature T0 degrees.

In the case where the sheet P having been transported to the nip portion N (see FIG. 2) is the A4 sheet P1, since the sheets P1 have the width W1 (see FIG. 3) that is shorter than the entire width W0 of the fixing belt 78, the non-sheet-pass-through range is formed at each end (outside the width W1 of the sheet P1) of the fixing belt 78 in the width direction W. Since the non-sheet-pass-through ranges of the fixing belt 78 are not subjected to heat exchange performed by contact of the fixing belt 78 with the sheet P2 in the nip portion N, the degree of reduction in temperature in the non-sheet-pass-through ranges is less than that in a sheet-pass-through range through which the sheet P1 passes.

The non-sheet-pass-through ranges of the fixing belt 78 where the temperature is higher than that in the sheet-pass-through range return to the solid heater 71 and are heated again by the resistance heating elements 72 through the glass coat 752. Repeating this operation maintains the temperature of the non-sheet-pass-through ranges of the fixing belt 78 at a temperature higher than the target temperature. Thus, the temperature of parts of the glass coat 752 corresponding to these non-sheet-pass-through ranges is not reduced but increased.

As a result, due to heat conduction from the parts of the glass coat 752 corresponding to the non-sheet-pass-through ranges, the temperature of the PTC elements 73 enclosed by these parts of the glass coat 752 increases and then exceeds the Curie temperature T0 degrees (see FIG. 6).

Figure 7:
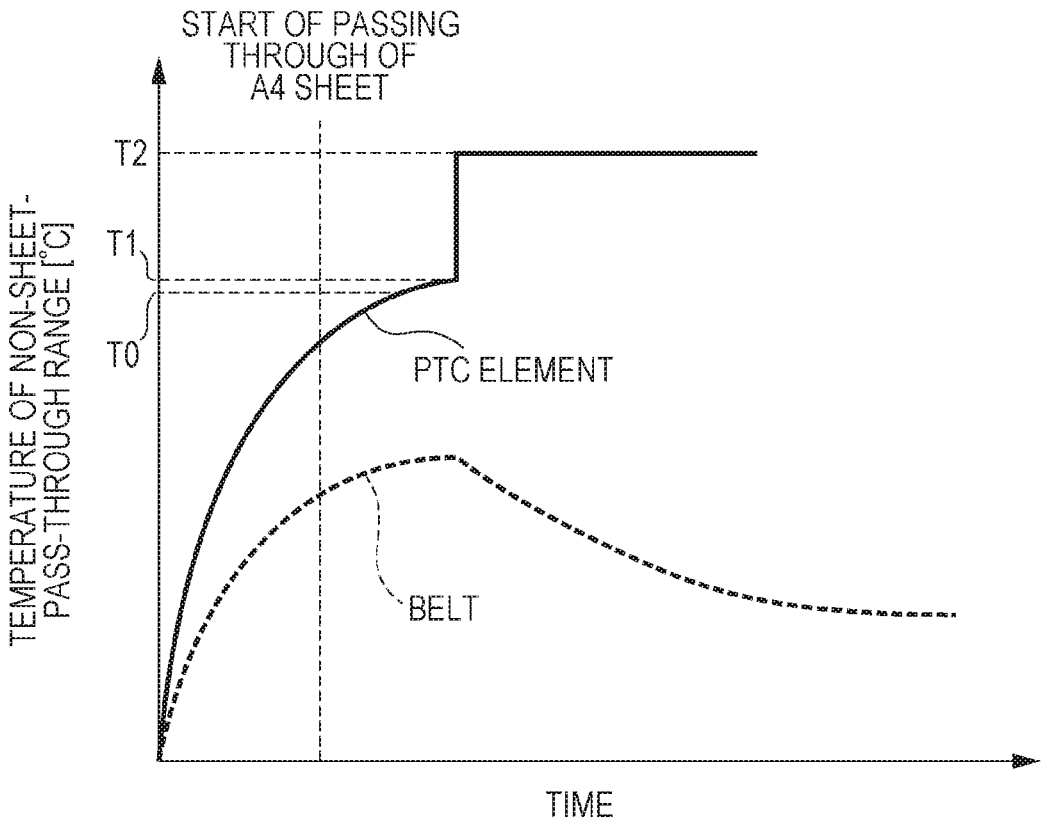
FIG. 7 illustrates the relationship between time elapsed from the start of passing of an A4 sheet through the fixing unit and the temperature of the PTC elements enclosed by parts of the glass coat corresponding to non-sheet-pass-through ranges.

FIG. 7 illustrates the relationship between time elapsed from the start of passing of the A4 sheet P1 through the fixing unit 60 and the temperature of the PTC elements 73 enclosed by the parts of the glass coat 752 corresponding to the non-sheet-pass-through ranges.

When the temperature of the PTC elements 73 in the parts corresponding to the non-sheet-pass-through ranges exceeds the Curie temperature T0 degrees, the resistivity of the PTC elements 73 steeply increases as illustrated in FIG. 6 and the resistance R2 (see FIG. 5) also increases. When the temperature of the PTC elements 73 reaches the temperature T1 degrees higher than the Curie temperature T0 degrees, the PTC elements 73 starts self-heating due to an effect of the increased resistance R2. As a result, as illustrated in FIG. 7, the temperature of the PTC elements 73 further steeply increases and instantaneously reaches the temperature T2 degrees that is higher than the temperature T1 degrees.

The resistivity of the PTC elements 73 the temperature of which has reached T2 degrees becomes, as seen from the characteristics illustrated in FIG. 6, equal to or more than several thousand times the resistivity under the normal environmental temperature, and the resistance R2 of the PTC elements 73 becomes 20 to 100 times the resistance R1 of the resistance heating elements 72. As a result, almost no current flows through the PTC elements 73 in the parts corresponding to the non-sheet-pass-through ranges and parts of the circuit connected in series with these PTC elements 73. Thus, the resistance heating elements 72 involved in heating of the fixing belt 78 do not generate heat.

Thus, the temperature of the parts of the glass coat 752 corresponding to the non-sheet-pass-through ranges starts to reduce, and the temperature of the non-sheet-pass-through ranges of the fixing belt 78 also starts to reduce and reaches the temperature lower than the target temperature as illustrated in FIG. 7.

Furthermore, heat of the non-sheet-pass-through ranges of the fixing belt 78 where the temperature is higher than that of the sheet-pass-through range is easily conducted to the sheet-pass-through range of the fixing belt 78 where the temperature is lower than that of the non-sheet-pass-through ranges through the base material 751 having a high heat conductivity. Thus, the temperature of the non-sheet-pass-through ranges of the fixing belt 78 is easily reduced. Since the heat conductivity of the base material 751 is high, an increased temperature may become almost uniform in the entirety of the fixing belt 78 (entirety of an object to be heated) within a short time period from the start of heating. Thus, a wait time period from the start of image formation may be reduced.

Even when the base material 751 is a single layer of the heat-resistant metal layer 751B, the base material 751 has the heat resistance against repeated heating. However, in this case, the heat conductivity of the base material 751 is reduced, and accordingly, heat is unlikely to be conducted through the base material 751. Thus, the temperature of the non-sheet-pass-through ranges of the fixing belt 78 is unlikely to be reduced. Even when the base material 751 is a single layer of the heat-conductive metal layer 751A, heat is easily conducted through the base material 751 because of a high heat conductivity. Thus, the temperature of the non-sheet-pass-through ranges of the fixing belt 78 is easily reduced. However, the heat resistance against repeated heating is low, and accordingly, the base material 751 may be easily degraded due to oxidation.

As described above, the heater unit 70, the fixing unit 60, and the image forming apparatus 1 according to the present exemplary embodiment may suppress the occurrence of a situation in which the temperature of the non-sheet-pass-through ranges of the fixing belt 78, through which the sheet P does not pass, is maintained at a temperature higher than the target temperature depending on the difference in size of the passing sheets P. As a result, heat load applied to parts of the heater unit 70, the fixing unit 60, and so forth corresponding to the non-sheet-pass-through ranges (for example, the fixing belt 78 (see FIG. 2) the base material 751, glass coat 752, and so forth) may be reduced compared to that in a structure in which the non-sheet-pass-through ranges are continued to be heated similarly to or in the same manner as the sheet-pass-through range. By reducing the heat load, reduction in life of the parts of the heater unit 70, the fixing unit 60, and so forth corresponding to the non-sheet-pass-through ranges due to the heat load may be suppressed.

When the resistance R2 of these PTC elements 73 steeply increases, almost no current flows through these PTC elements 73. However, there still is a small amount of current flowing through the PTC elements 73. Accordingly, the temperature of the PTC elements 73 is maintained at the temperature T2 degrees as illustrated in FIG. 7.

The temperature T2 degrees is higher than the heating temperature of the resistance heating elements 72 corresponding to the sheet-pass-through range. However, each of the regions S2 (see FIG. 3) where the PTC elements 73 are disposed is much smaller than a corresponding one of the regions S1 where the resistance heating elements 72 are disposed. Thus, even when the PTC elements 73 generate heat of the high temperature T2 degrees in the non-sheet-pass-through ranges, this does not become output sufficient to heat the non-sheet-pass-through ranges of the fixing belt 78 through the glass coat 752.

Accordingly, the PTC elements 73 of the heater unit 70 according to the present exemplary embodiment do not have a function of heating the fixing belt 78.

As illustrated in FIG. 4, since the PTC elements 73 are disposed closer to the base material 751 than the resistance heating elements 72, the distance in the depth direction between the PTC elements 73 and the fixing belt 78 in contact with the outer circumferential surface of the glass coat 752 is greater than that between the resistance heating elements 72 and the fixing belt 78 in contact with the outer circumferential surface of the glass coat 752. Accordingly, also from this viewpoint, the thermal effect produced by the PTC elements 73 on the fixing belt 78 is smaller than that produced by the resistance heating elements 72.

In the above description, in a part corresponding to the sheet-pass-through range through which the A4 sheet P1 passes, the temperature of the PTC elements 73 does not exceed the Curie temperature T0 degrees. Thus, operations of the resistance heating elements 72 and the PTC elements 73 in the part corresponding to the sheet-pass-through range is the same as those performed when the B4 sheet P2 passes through the sheet-pass-through range.

Other Exemplary Embodiments

Heat Conduction Suppressing Portion

Figure 8:
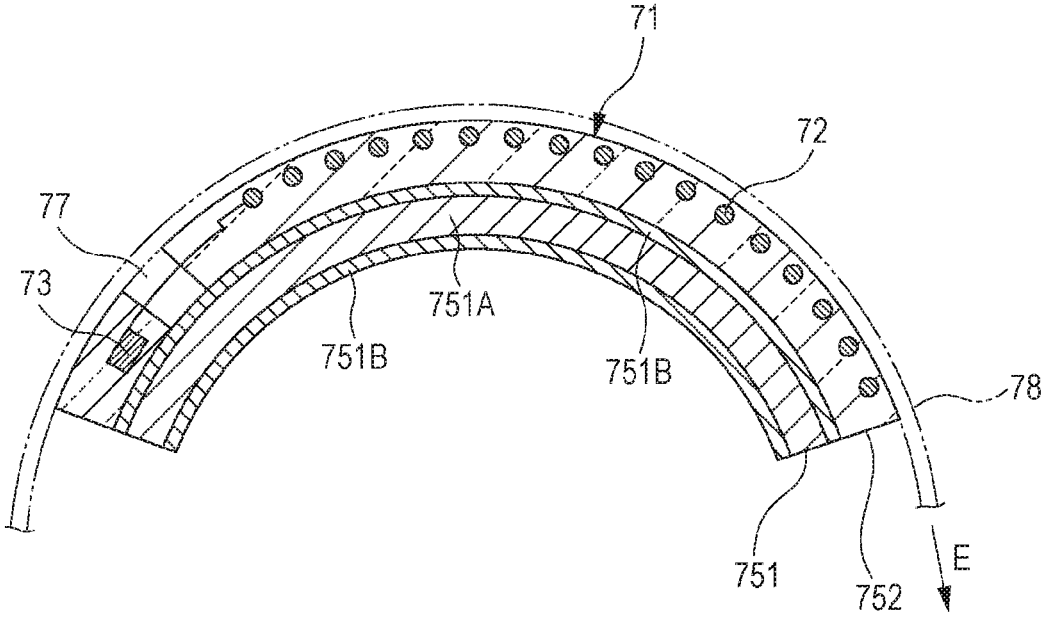
FIG. 8 is a sectional view corresponding to FIG. 4, illustrating a structure provided with a heat conduction suppressing portion, which suppresses heat conduction, between resistance heating elements and the PTC elements.

FIG. 8 is a sectional view corresponding to FIG. 4, illustrating a structure provided with a heat conduction suppressing portion 77, which suppresses heat conduction, between the resistance heating elements 72 and the PTC elements 73.

As illustrated in FIG. 4, the heater unit 70 according to the above-described exemplary embodiment has a structure in which the resistance heating elements 72 together with the PTC elements 73 each connected in series with a corresponding one of the resistance heating elements 72 are enclosed by the glass coat 752. This heater unit 70 may include the heat conduction suppressing portion 77, which suppresses heat conduction, between the resistance heating elements 72 and the PTC elements 73 as illustrated in FIG. 8.

As the heat conduction suppressing portion 77, a portion or the like may be used in which a material having a lower heat conductivity than that of the glass coat 752 is disposed. For example, as illustrated in FIG. 8, by forming a slit in the glass coat 752, an air layer is formed. This air layer may be used as the heat conduction suppressing portion 77. Alternatively, the heat conduction suppressing portion 77 may be formed by filling this slit with a material having a lower heat conductivity than that of the glass coat 752 such as resin or ceramic.

With the heater unit 70 provided with the heat conduction suppressing portion 77 between the resistance heating elements 72 and the PTC elements 73 as described above, even when heat generated by the resistance heating elements 72 is conducted to the glass coat 752, the heat conduction suppressing portion 77 suppresses conduction of the heat from the glass coat 752 to the PTC elements 73.

As a result, a steep increase of the resistance R2 of the PTC elements 73 affected by heating of the resistance heating elements 72 is suppressed before the temperature of the resistance heating elements 72 reaches an objective temperature (the temperature with which the fixing belt 78 is heated to the temperature required for the fixing belt 78 to fix the unfixed superposed toner images onto the sheet P) so as to prevent the resistance heating elements 72 from stopping the heating before the temperature of the resistance heating elements 72 reaches the objective temperature.

Arrangement of the PTC Elements

Figure 9:
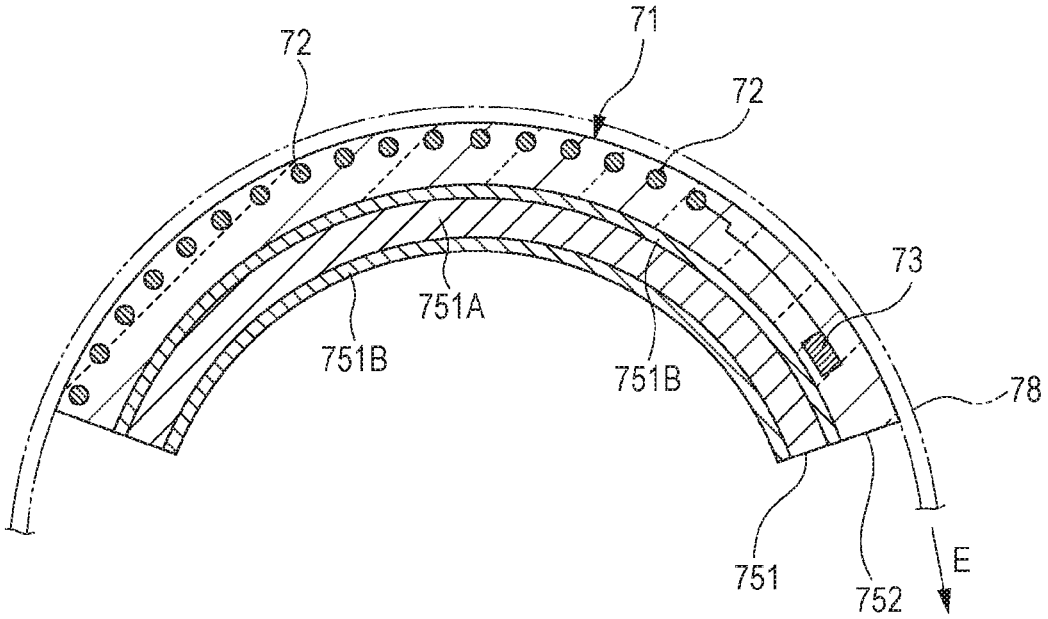
FIG. 9 is a sectional view corresponding to FIG. 4, illustrating the solid heater having a structure in which the PTC elements are disposed downstream of the resistance heating elements in an arrow E direction, which is a fixing belt rotating direction.

FIG. 9 is a sectional view corresponding to FIG. 4, illustrating the solid heater 71 having a structure in which the PTC elements 73 are disposed downstream of the resistance heating elements 72 in the arrow E direction, which is the fixing belt 78 rotating direction. The PTC elements 73 are disposed downstream of the resistance heating elements 72 in the arrow E direction, which is the fixing belt 78 rotating direction, in the solid heater 71 illustrated in FIG. 9. As is the case with the solid heater 71 illustrated in FIG. 4, the solid heater 71 illustrated in FIG. 9 may suppress the occurrence of a situation in which the temperature of the parts of the fixing belt 78 corresponding to the non-sheet-pass-through ranges, through which the sheet P does not pass, is maintained at a temperature higher than the target temperature depending on the difference in size of the sheets P passing through the fixing unit 60.

As a result, heat load applied to the parts of the heater unit 70 (see FIG. 2), the fixing unit 60, and so forth corresponding to the non-sheet-pass-through ranges may be reduced compared to that in a structure in which the non-sheet-pass-through ranges are continued to be heated similarly to or in the same manner as the sheet-pass-through range. By reducing the heat load, reduction in life of the parts of the heater unit 70, the fixing unit 60, and so forth corresponding to the non-sheet-pass-through ranges due to the heat load may be suppressed.

Figure 10:
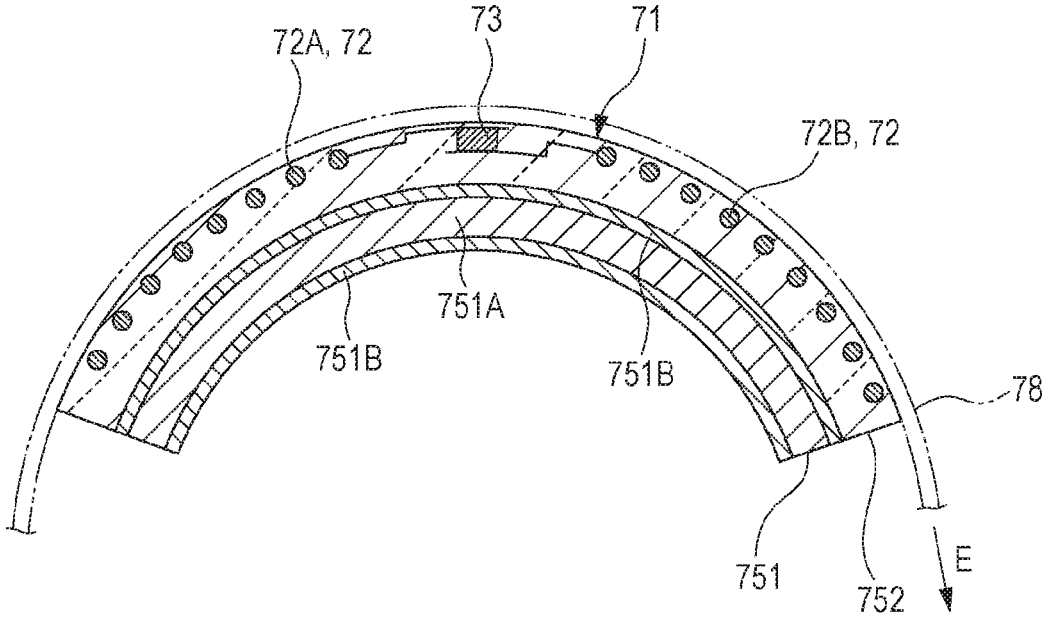
FIG. 10 is a sectional view corresponding to FIG. 4, illustrating the solid heater having a structure in which the PTC elements are disposed between the resistance heating elements on the relatively upstream side and the resistance heating elements on the relatively downstream side in the arrow E direction, which is the fixing belt rotating direction.

FIG. 10 is a sectional view corresponding to FIG. 4, illustrating the solid heater 71 having a structure in which the PTC elements 73 are disposed between resistance heating elements 72A on the relatively upstream side (the resistance heating elements 72 disposed on the relatively upstream side) and resistance heating elements 72B on the relatively downstream side (the resistance heating elements 72 disposed on the relatively downstream side) in the arrow E direction, which is the fixing belt 78 rotating direction.

In the solid heater 71 illustrated in FIG. 10, the PTC elements 73 are disposed downstream of the resistance heating elements 72A on the relatively upstream side in the arrow E direction, which is the fixing belt 78 rotating direction, and upstream of the resistance heating elements 72B on the relatively downstream side in the arrow E direction, which is the fixing belt 78 rotating direction.

As is the case with the solid heater 71 illustrated in FIG. 4, the solid heater 71 illustrated in FIG. 10 may suppress the occurrence of a situation in which the temperature of the parts of the fixing belt 78 corresponding to the non-sheet-pass-through ranges, through which the sheet P does not pass, is maintained at a temperature higher than the target temperature depending on the difference in size of the sheets P passing through the fixing unit 60. As a result, heat load applied to the parts of the heater unit 70 (see FIG. 2), the fixing unit 60, and so forth corresponding to the non-sheet-pass-through ranges may be reduced compared to that in a structure in which the non-sheet-pass-through ranges are continued to be heated similarly to or in the same manner as the sheet-pass-through range. By reducing the heat load, reduction in life of the parts of the heater unit 70, the fixing unit 60, and so forth corresponding to the non-sheet-pass-through ranges due to the heat load may be suppressed.

Although an integrated structure is realized by arranging the PTC elements 73 on the base material 751, on which the resistance heating elements 72 are also arranged, the PTC elements 73 are not necessarily arranged on the base material 751.

Shape of the Base Material

Figure 11:
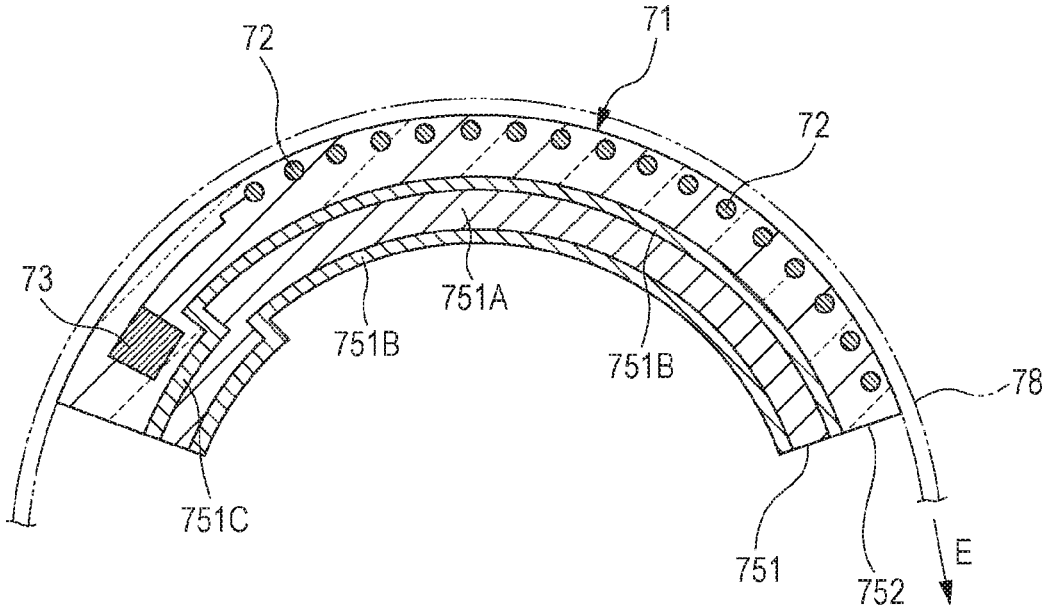
FIG. 11 is a sectional view corresponding to FIG. 4, illustrating a variation of the shape of a base material having steps formed therein when the thickness of the PTC elements is large.
Figure 12:
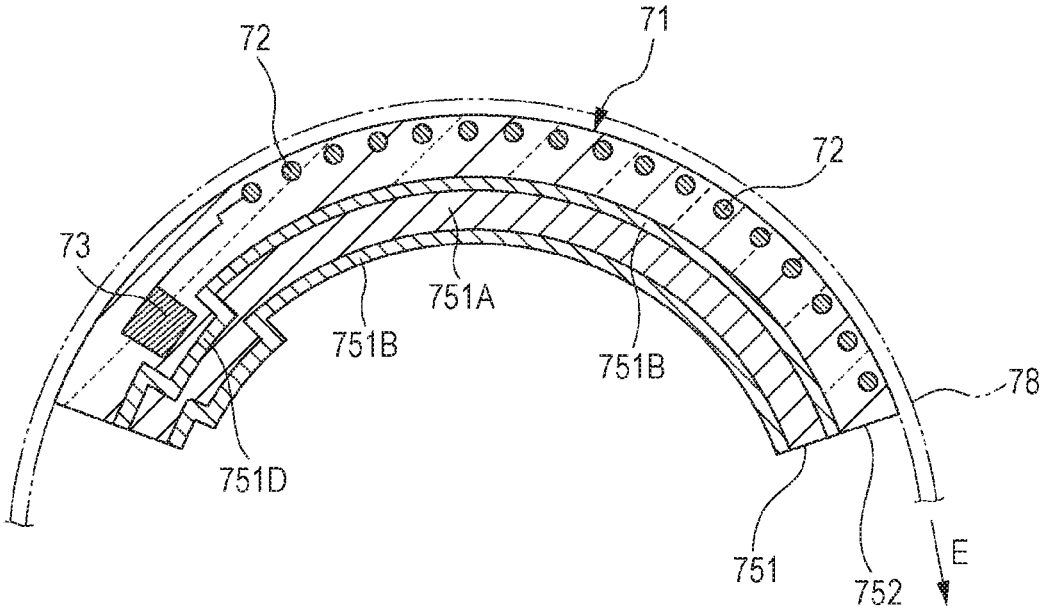
FIG. 12 is a sectional view corresponding to FIG. 4, illustrating a variation of the shape of the base material having recesses formed therein when the thickness of the PTC elements is large.

FIGS. 11 and 12, which are sectional views corresponding to FIG. 4, illustrate variations of the shape of the base material 751 when the thickness of the PTC elements 73 is larger than that of the PTC elements 73 illustrated in, for example, FIG. 4. Specifically, FIG. 11 illustrates a shape having steps 751C formed in the base material 751, and FIG. 12 illustrates a shape having recesses 751D formed in the base material 751.

In the solid heater 71 illustrated in FIG. 11, portions of the base material 751 where the PTC elements 73 are disposed are lowered (the radius is reduced in the radial direction) due to the formation of the steps 751C, and the thickness of the glass coat 752 is increased in the amount by which the portions of the base material 751 are lowered. Thus, even when the thickness of the PTC elements 73 is larger than that of the PTC elements 73 illustrated in, for example, FIG. 4, the PTC elements 73 are disposed inside the glass coat 752.

In the solid heater 71 illustrated in FIG. 12, portions of the base material 751 where the PTC elements 73 are disposed are lowered due to the formation of the recesses 751D, and the thickness of the glass coat 752 is increased in the amount by which the portions of the base material 751 are lowered. Thus, even when the thickness of the PTC elements 73 is larger than that of the PTC elements 73 illustrated in, for example, FIG. 4, the PTC elements 73 are disposed inside the glass coat 752.

Figure 13:
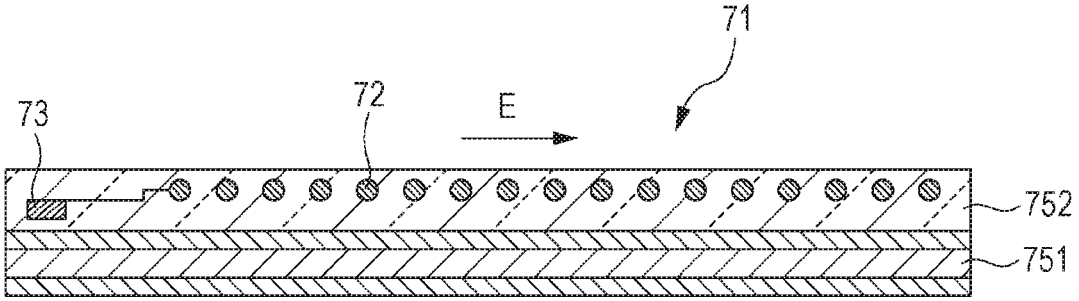
FIG. 13 is a sectional view corresponding to FIG. 4, illustrating a variation of the shape of the base material having a flat shape.
Figure 14:
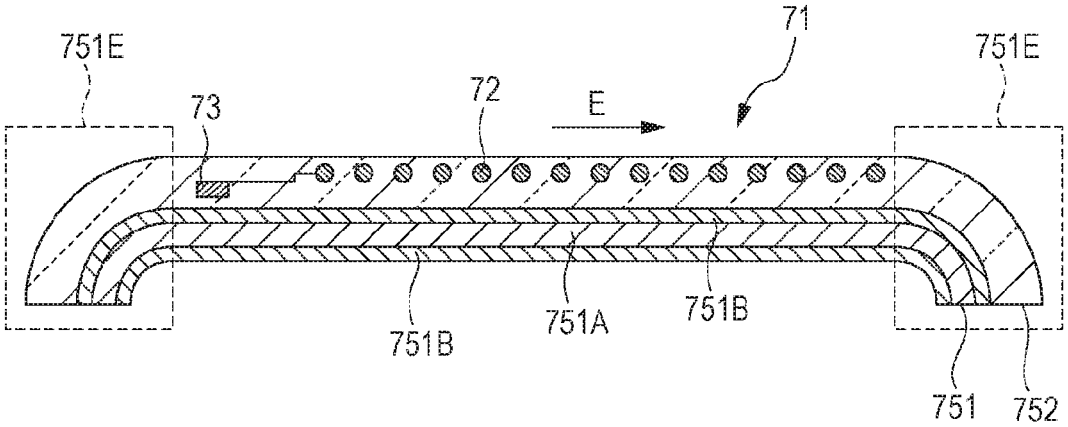
FIG. 14 is a sectional view corresponding to FIG. 4, illustrating a variation of the shape of the base material formed by rounding end portions of the flat base material illustrated in FIG. 13, the end portions being located on the upstream side and the downstream side in the arrow E direction, which is the fixing belt rotating direction.

FIGS. 13 and 14 are sectional views corresponding to FIG. 4, illustrating variations of the shape of the base material 751. Specifically, FIG. 13 illustrates the base material 751 having a flat shape, and FIG. 14 illustrates the base material 751 having rounded end portions (by curving only end portions) 751E of the flat base material 751 illustrated in FIG. 13, the end portions 751E being located on the upstream side and the downstream side in the arrow E direction, which is the fixing belt 78 rotating direction.

With the solid heater 71 having the base material 751 illustrated in FIG. 13 or 14 as described above, heat may be conducted to the fixing belt 78 rotating in the arrow E direction while being in contact with the surface of the glass coat 752 (see FIG. 4).

Electrodes of the Electrical Circuit

Figure 15:
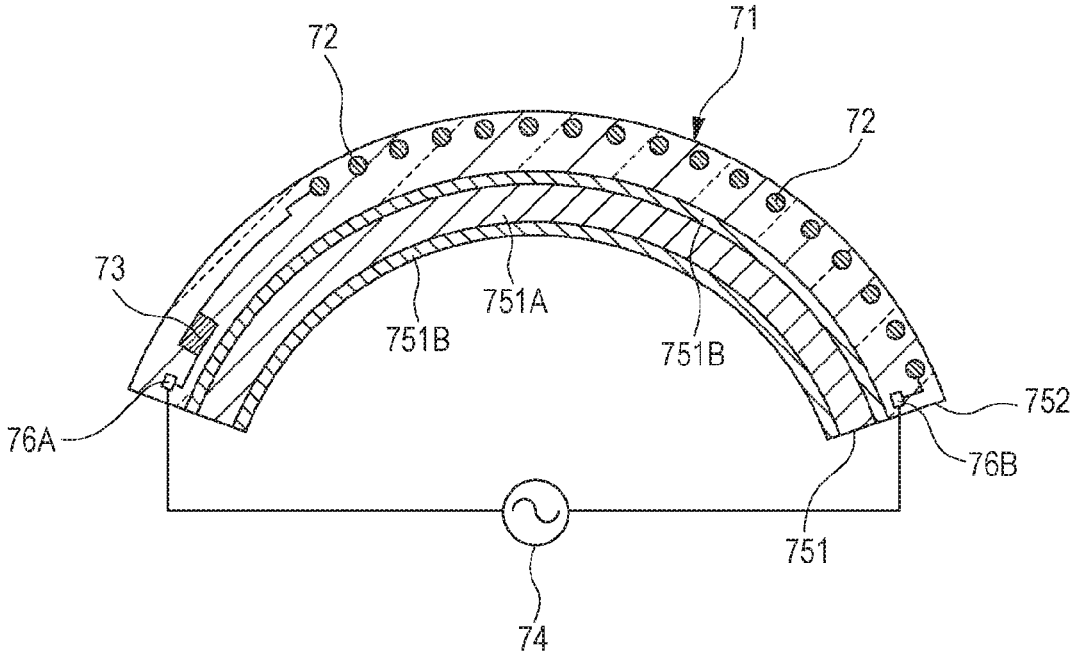
FIG. 15 is a schematic view in which the electrical circuit illustrated in FIG. 5 is represented in the sectional view illustrated in FIG. 4.

FIG. 15 is a schematic view in which the electrical circuit illustrated in FIG. 5 is represented in the sectional view illustrated in FIG. 4. As illustrated in FIG. 15, the base material 751 of the solid heater 71 illustrated in FIG. 4 is actually provided with a first electrode 76A and a second electrode 76B. The first electrode 76A is connected to the PTC elements 73 and the second electrode 76B is connected to the resistance heating elements 72. The electrical circuit illustrated in FIG. 5 is formed by connecting the first electrode 76A and the second electrode 76B to the power source 74.

Figure 16:
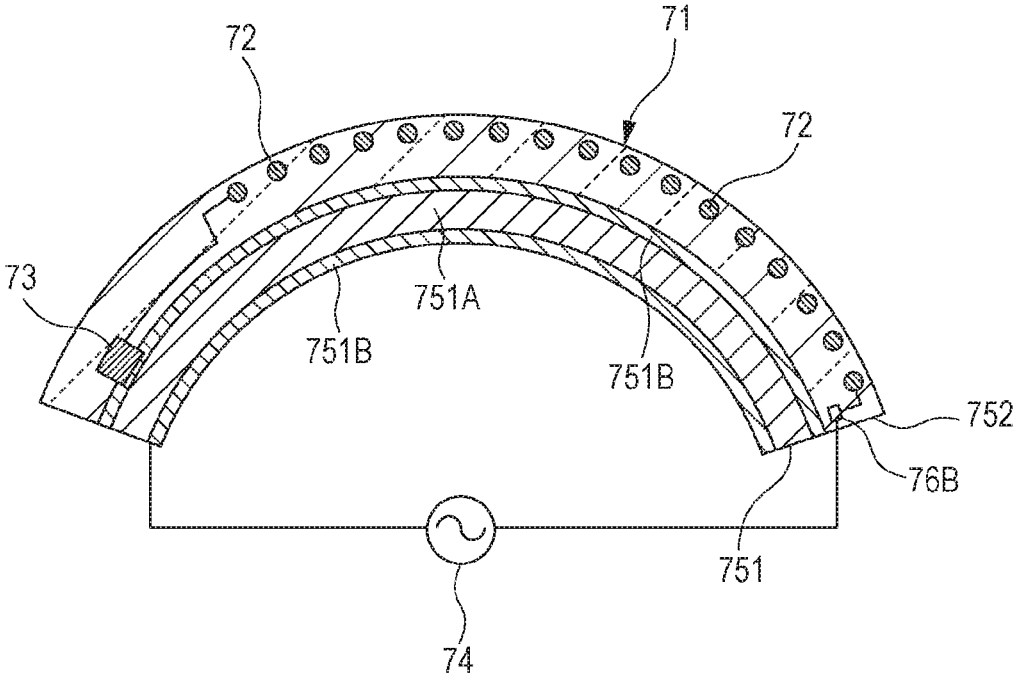
FIG. 16 is a schematic view of a structure in which the PTC elements illustrated in FIG. 15 are connected to an electrically conductive base material, and this base material and a second electrode are connected to a power source.

FIG. 16 is a schematic view of a structure in which the PTC elements 73 illustrated in FIG. 15 are connected to the electrically conductive base material 751, and this base material 751 and the second electrode 76B are connected to the power source 74. Since the base material 751 illustrated in FIG. 16 functions as the first electrode 76A illustrated in FIG. 15, the structure of the solid heater 71 may be more simplified than that of the solid heater 71 in which the first electrode 76A is formed.

It is noted that a region of the surface of the base material 751 of the solid heater 71 illustrated in FIG. 16 except for parts connected to the power source 74 may be insulated from surrounding members by, for example, covering this region by an insulating layer.

The Solid Heater

The solid heater 71 does not necessarily include the PTC elements 73. That is, the solid heater 71 may be in a form that does not include the PTC elements 73 and includes the resistance heating elements 72 (each serving as the example of the heating element) and the base material 751, on the surface of which the resistance heating elements 72 are disposed.

Even when the solid heater 71 does not include the PTC elements 73, the solid heater 71 includes the base material 751 having a high heat conductivity. Accordingly, heat of the non-sheet-pass-through ranges of the fixing belt 78 where the temperature is higher than that of the sheet-pass-through range is easily conducted to the sheet-pass-through range of the fixing belt 78 where the temperature is lower than that of the non-sheet-pass-through ranges through the base material 751 having a high heat conductivity. Thus, the temperature of the non-sheet-pass-through ranges of the fixing belt 78 is easily reduced. Thus, even without the PTC elements 73, the heater unit 70, the fixing unit 60, and the image forming apparatus 1 according to the present exemplary embodiment may suppress the occurrence of a situation in which the temperature of the non-sheet-pass-through ranges of the fixing belt 78, through which the sheet P does not pass, is maintained at a temperature higher than the target temperature depending on the difference in size of the passing sheets P. As a result, heat load applied to parts of the heater unit 70, the fixing unit 60, and so forth corresponding to the non-sheet-pass-through ranges (for example, the fixing belt 78 (see FIG. 2) the base material 751, the glass coat 752, and so forth) may be reduced compared to that in a structure in which the non-sheet-pass-through ranges are continued to be heated similarly to or in the same manner as the sheet-pass-through range. By reducing the heat load, reduction in life of the parts of the heater unit 70, the fixing unit 60, and so forth corresponding to the non-sheet-pass-through ranges due to the heat load may be suppressed.

Furthermore, since the heat conductivity of the base material 751 is high, the increased temperature may become almost uniform in the entirety of the fixing belt 78 (entirety of the object to be heated) within a short time period from the start of heating. Thus, the wait time period from the start of image formation may be reduced.

Figure 17:
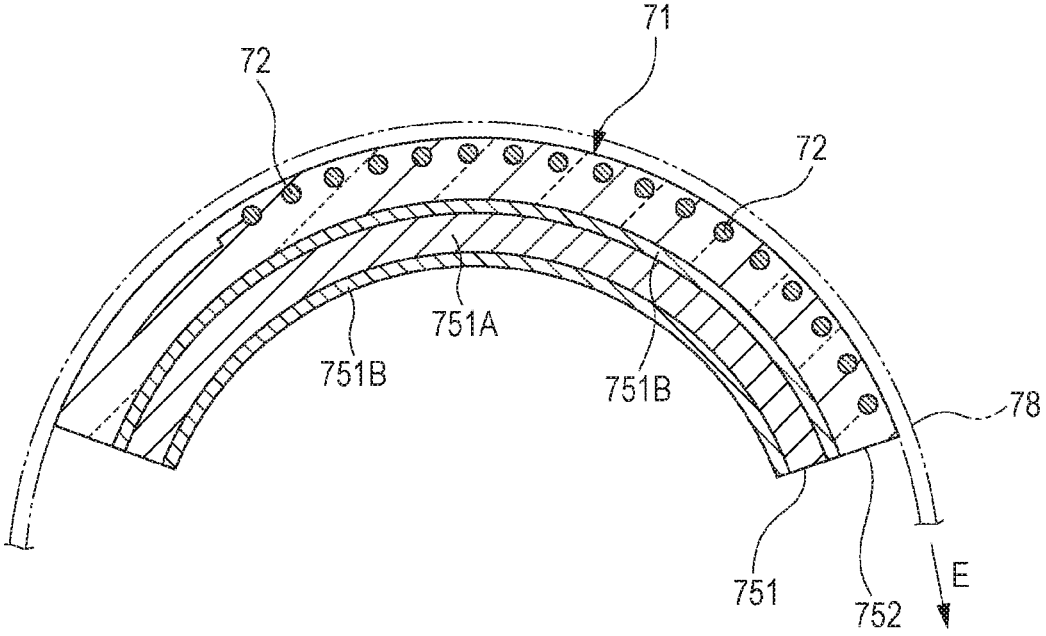
FIG. 17 is a sectional view of the solid heater in another form.
Figure 18:
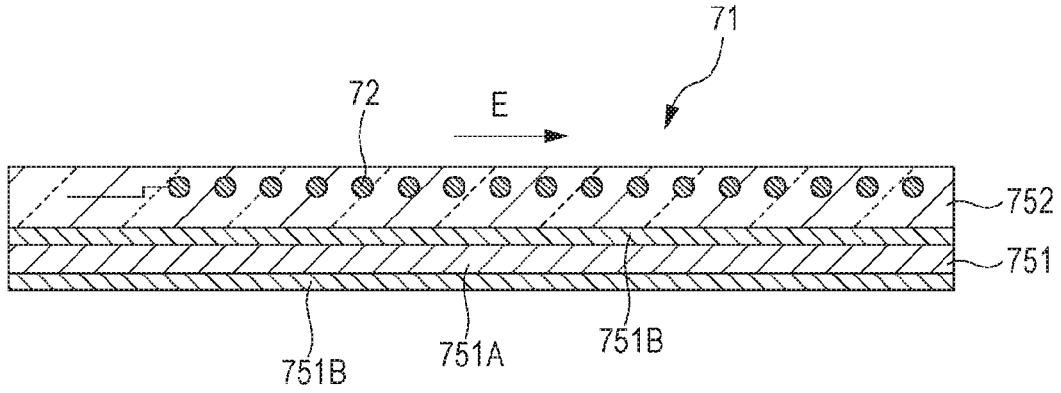
FIG. 18 is a sectional view of the solid heater in yet another form.
Figure 19:
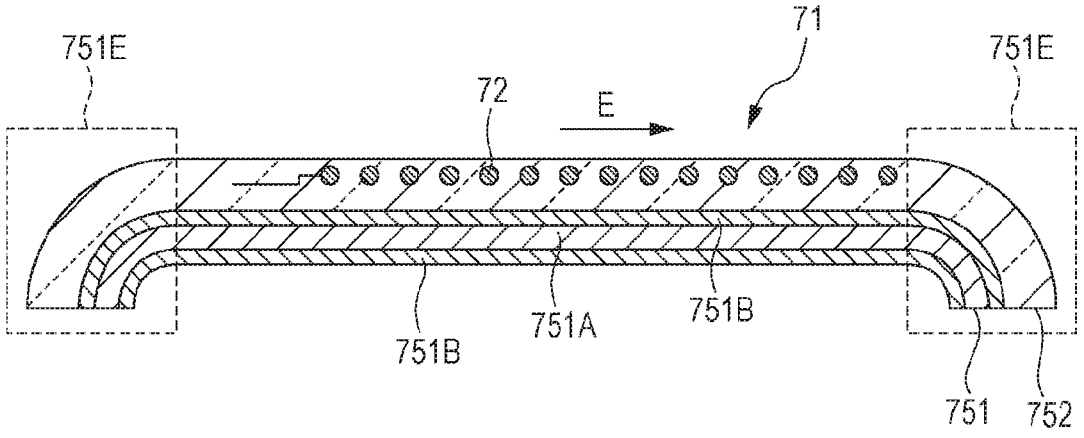
FIG. 19 is a sectional view of the solid heater in yet another form.

The solid heater 71 without the PTC elements 73 may instead be any one of the following forms: a form that includes the curved base material 751 as illustrated in FIG. 17; a form that includes the flat base material 751 as illustrated in FIG. 18; and a form that includes the base material 751 having the rounded end portions 751E (base material 751 curved only at the end portions) on the upstream and downstream sides in the arrow E direction, which is the fixing belt 78 rotating direction, as illustrated in FIG. 19. FIGS. 17 to 19 are sectional views corresponding to FIG. 4. The same members as those of FIG. 4 are denoted by the same reference numerals as those of FIG. 4 in FIGS. 17 to 19.

The solid heater 71 is used to heat the fixing belt 78 of the fixing unit 60, the fixing belt 78 serving as the objects to be heated. In addition, the solid heater 71 is used as a heat source utilized in any of, for example, various analyzers, semiconductor manufacturing apparatuses, various plants, home appliances, housing facilities, and so forth.

Examples

Although examples of the present invention will be described below, the present invention is not limited to the examples below.

Fabrication of Base Materials

Fabrication of Base Materials 1 to 7 and 14

For each of the base materials 1 to 7 and 14, a SUS430 sheet that becomes one of a pair of heat-resistant metal layers, an oxygen-free Cu sheet that becomes a heat-conductive metal layer, and another SUS430 sheet that becomes the other of the pair of heat-resistant metal layers are rolled so that these sheets have respective target thicknesses. Oxide films are removed from surfaces of these sheets. After that, these rolled sheets are joined to one another by cold rolling.

Next, the joined sheets are heated for 60 minutes at 900° C. so as to perform diffusion bonding between the joined sheets. The diffusion bonded sheets are processed by cold rolling so that the diffusion bonded sheets have a total target thickness (0.2 mm, 0.25 mm, or 0.3 mm). Thus, clad sheets are obtained.

The obtained clad sheets are processed by press punching so as to obtain the base materials having a size of 30 mm in width×418 mm in length. Through these processes, the flat base materials 1 to 7 and 14 in each of which the heat-conductive metal layer (oxygen-free Cu layer) is interposed between the pair of heat-resistant metal layers (SUS430 layers) (see FIG. 13) are obtained. The obtained base materials 1 to 7 and 14 have the thicknesses and the ratios of thicknesses between the layers as listed in Table 1.

Fabrication of Base Materials 8 to 13

End portions of the flat base materials 1 to 6 in the width direction are bent so as to obtain the base materials 8 to 13, the end portions of which are curved to have a radius of curvature R=12.5 mm (see FIG. 14). The shape of each of the base materials 8 to 13 is represented as "R=12.5 mm" in Table 1.

Fabrication of Base Materials 15 to 18

SUS430 sheets are processed by cold rolling so that the SUS430 sheets have target thicknesses (0.2 mm and 0.3 mm).

The SUS430 sheets having been processed by cold rolling are processed by press punching so as to obtain base materials having a size of 30 mm in width×418 mm in length. Through these processes, the flat base materials 15 to 18 that each include a single heat-resistant metal layer (SUS430 layer) are obtained. The obtained flat base materials 15 to 18 have the thicknesses as listed in Table 1 (see FIG. 13).

Fabrication of Base Materials 19 to 22

End portions of the flat base materials 15 to 18 in the width direction are bent so as to obtain the base materials 19 to 22, the end portions of which are curved to have a radius of curvature R=12.5 mm (see FIG. 14). The shape of each of the base materials 15 to 18 is represented as "R=12.5 mm" in Table 1.

First to Fourteenth Examples and First to Eighth Comparative Examples

Solid heaters of first to fourteenth examples and first to eighth comparative examples are fabricated by using the base materials listed in Table 1 and performing the following processes: that is, forming an insulating glass layer, forming silver electrodes and silver wiring, forming the resistance heating elements, mounting the PTC elements, and forming a glass coat layer on each of the base materials (see FIGS. 13 and 14).

However, the PTC elements are not mounted on the solid heaters of the third, fifth, seventh, ninth, eleventh, thirteenth, and fourteenth examples and the second, fourth, sixth, and eighth comparative examples so as to obtain the solid heaters without the PTC elements (see FIGS. 18 and 19).

Evaluations

Evaluation of Temperature Increase in a Non-Sheet-Pass-Through Portion

Temperature Difference Between a Sheet-Pass-Through Portion and the Non-Sheet-Pass-Through Portion The solid heaters of the examples and the comparative examples are each attached to a fixing device (fixing unit) having a structure similar to that illustrated in FIG. 2. With this fixing device, 100 A4 sheets being transported in the longitudinal direction of the sheets are caused to continuously pass through the solid heater. The temperature is measured in a sheet-pass-through portion and a non-sheet-pass-through portion when the sheets pass therethrough. After 100 sheets have been passed, the temperature difference between the sheet-pass-through portion and the non-sheet-pass-through portion are checked. The results are listed in Table 1.

Evaluations with an Actual Apparatus

Fixing Wait Time

The solid heaters of the examples and the comparative examples are each attached to a fixing device of an image forming apparatus (DocuPrintC620 manufactured by Fuji Xerox Co., Ltd.). With this image forming apparatus, 100 A4 sheets being transported in the longitudinal direction of the sheets are caused to continuously pass through the solid heater. After the sheets have passed, a time period required for the solid heater to become ready for fixing (fixing wait time until the surface temperature of the fixing belt becomes uniform) the A4 sheets being transported in the transverse direction of the sheets is measured. Then, a halftone image of 50% image density is formed, and the image quality of the image is evaluated in terms of the following evaluation criterion. The results are listed in Table 1.

The Evaluation Criterion for the Image Quality

A: No density unevenness observed

B: Slight density unevenness observed

C: Some density unevenness observed

D: Density unevenness observed

Durability of the Solid Heaters

The durability of the solid heaters is evaluated as follows. The solid heaters of the examples and the comparative examples are each attached to the fixing device of the image forming apparatus (DocuPrintC620 manufactured by Fuji Xerox Co., Ltd.). With this image forming apparatus, the following heating test is repeatedly performed: 100 A4 sheets being transported in the longitudinal direction of the sheets are caused to continuously pass through the solid heater, and after that, the heating is stopped so that the temperature of the solid heater is returned to room temperature. The evaluation criterion is as follows:

The Evaluation Criterion for the Durability

A: No problem when repeating the test with 100 sheets more than 10,000 times.

B: Wiring is broken when the test with 100 sheets is repeated more than 7,000 to 10,000 times.

$B^-$: Wiring is broken when the test with 100 sheets is repeated more than 5,000 times to 7,000 times.

C: Wiring is broken when the test with 100 sheets is repeated more than 3,000 times to 5,000 times.

D: Wiring is broken when the test with 100 sheets is repeated 3,000 times or less.

TABLE 1

| | Base material | Shape of base material | Thickness of base material (mm) | Material of base material | Layer structure of base material (Ratio of thicknesses between layers) SUS430 layer | Cu layer | SUS430 layer | PTC element | Evaluation of temperature in non-sheet-pass-through portion: Temperature of sheet-pass-through region (° C.) | Temperature of non-sheet-pass-through region (° C.) | Temperature difference Δ (° C.) | Evaluation results with actual apparatus: Fixing wait time (sec) | Image quality | Solid heater Durability |
|---|---|---|---|---|---|---|---|---|---|---|---|---|---|---|
| First example | Base material 1 | Flat | 0.2 | Clad sheet | 15 | 1 | 15 | Provided | 150.0 | 178.0 | 28.0 | 0 | C | B- |
| Second example | Base material 2 | Flat | 0.2 | Clad sheet | 10 | 1 | 10 | Provided | 150.0 | 170.0 | 20.0 | 0 | A | A |
| Third example | Base material 3 | Flat | 0.2 | Clad sheet | 6 | 1 | 6 | Not Provided | 150.0 | 180.0 | 30.0 | 0 | B | B |
| Fourth example | Base material 4 | Flat | 0.25 | Clad sheet | 3 | 1 | 3 | Provided | 150.0 | 163.0 | 13.0 | 0 | A | A |
| Fifth example | Base material 5 | Flat | 0.25 | Clad sheet | 1 | 1 | 1 | Not Provided | 150.0 | 177.0 | 27.0 | 0 | B | B |
| Sixth example | Base material 6 | Flat | 0.3 | Clad sheet | 1 | 2 | 1 | Provided | 150.0 | 159.0 | 9.0 | 0 | A | A |
| Seventh example | Base material 7 | Flat | 0.3 | Clad sheet | 1 | 3 | 1 | Not Provided | 150.0 | 174.0 | 24.0 | 0 | B | A |
| Eighth example | Base material 8 | R = 12.5 mm | 0.2 | Clad sheet | 10 | 1 | 10 | Provided | 150.0 | 168.0 | 18.0 | 0 | A | A |
| Ninth example | Base material 9 | R = 12.5 mm | 0.2 | Clad sheet | 6 | 1 | 6 | Not Provided | 150.0 | 178.0 | 28.0 | 0 | B | B |
| Tenth example | Base material 10 | R = 12.5 mm | 0.25 | Clad sheet | 3 | 1 | 3 | Provided | 150.0 | 162.0 | 12.0 | 0 | A | A |
| Eleventh example | Base material 11 | R = 12.5 mm | 0.25 | Clad sheet | 1 | 1 | 1 | Not Provided | 150.0 | 175.0 | 25.0 | 0 | B | B |
| Twelfth example | Base material 12 | R = 12.5 mm | 0.3 | Clad sheet | 1 | 2 | 1 | Provided | 150.0 | 157.0 | 7.0 | 0 | A | A |
| Thirteenth example | Base material 13 | R = 12.5 mm | 0.3 | Clad sheet | 1 | 3 | 1 | Not Provided | 150.0 | 172.0 | 22.0 | 0 | B | A |
| Fourteenth example | Base material 14 | Flat | 0.3 | Clad sheet | 1 | 5 | 1 | Not Provided | 150.0 | 163.0 | 13.0 | 0 | B | B- |
| First Comparative Example | Base material 15 | Flat | 0.2 | SUS430 sheet | Single layer (SUS430 layer) | | | Provided | 150.0 | 200.0 | 50.0 | 50 | C | C |
| Second Comparative Example | Base material 16 | Flat | 0.2 | SUS430 sheet | Single layer (SUS430 layer) | | | Not Provided | 150.0 | 210.0 | 60.0 | 200 | D | D |
| Third Comparative Example | Base material 17 | Flat | 0.3 | SUS430 sheet | Single layer (SUS430 layer) | | | Provided | 150.0 | 194.0 | 44.0 | 40 | C | C |
| Fourth Comparative Example | Base material 18 | Flat | 0.3 | SUS430 sheet | Single layer (SUS430 layer) | | | Not Provided | 150.0 | 205.0 | 55.0 | 100 | D | D |
| Fifth Comparative Example | Base material 19 | R = 12.5 mm | 0.2 | SUS430 sheet | Single layer (SUS430 layer) | | | Provided | 150.0 | 195.0 | 45.0 | 40 | C | C |
| Sixth Comparative Example | Base material 20 | R = 12.5 mm | 0.2 | SUS430 sheet | Single layer (SUS430 layer) | | | Not Provided | 150.0 | 207.0 | 57.0 | 180 | D | D |
| Seventh Comparative Example | Base material 21 | R = 12.5 mm | 0.3 | SUS430 sheet | Single layer (SUS430 layer) | | | Provided | 150.0 | 190.0 | 40.0 | 30 | C | C |
| Eighth Comparative Example | Base material 22 | R = 12.5 mm | 0.3 | SUS430 sheet | Single layer (SUS430 layer) | | | Not Provided | 150.0 | 199.0 | 49.0 | 90 | D | D |

From the above-described results, it may be understood that, compared to the solid heaters of the comparative examples, the temperature difference between a sheet-pass-through region and a non-sheet-pass-through region of the fixing belt is reduced and the increase in temperature of the non-sheet-pass-through range is suppressed with the solid heaters of the present examples. It may also be understood that the fixing wait time is reduced and the increased temperature becomes almost uniform in the entirety of the fixing belt within a short time period from the start of heating.

It may also be understood that the solid heaters of the present examples have heat resistance substantially equal to the base materials of the comparative examples that include a single SUS430 layer, which is the heat-resistant metal layer.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating device comprising:

a belt member that is rotated;

a plurality of heating elements that are arranged in a width direction of the belt member and that generate heat so as to heat the belt member;

a plurality of resistance elements that have positive temperature coefficients and that are connected to the plurality of heating elements such that each of the plurality of resistance elements is connected in series with a corresponding one of the plurality of heating elements; and a base material that includes a heat-conductive metal layer and a pair of heat-resistant metal layers between which the heat-conductive metal layer is interposed and that has a surface on which the plurality of heating elements and the plurality of resistance elements are disposed, wherein a temperature of the belt member is reduced by an increase in resistances of the plurality of resistance elements caused by an increase in temperatures of the plurality of resistance elements.

2. The heating device according to claim 1, wherein the heat-conductive metal layer is one of a copper layer, an aluminum layer, a silver layer, and a bronze (Cu—Sn) layer, and wherein each of the pair of heat-resistant metal layers is one of a stainless steel layer, a nickel layer, an Ni—Cr layer, and a titanic layer.

3. The heating device according to claim 1, wherein, in the base material, a ratio between a layer thickness of each of the pair of heat-resistant metal layers and a layer thickness of the heat-conductive metal layer represented by the layer thickness of each of the pair of heat-resistant metal layers/the layer thickness of the heat-conductive metal layer is from 1/3 to 10/1.

4. The heating device according to claim 1, wherein, in the base material, a ratio between a layer thickness of each of the pair of heat-resistant metal layers and a layer thickness of the heat-conductive metal layer represented by the layer thickness of each of the pair of heat-resistant metal layers/the layer thickness of the heat-conductive metal layer is from 1/2 to 8/1.

5. The heating device according to claim 1, wherein, in the base material, a ratio between a layer thickness of each of the pair of heat-resistant metal layers and a layer thickness of the heat-conductive metal layer represented by the layer thickness of each of the pair of heat-resistant metal layers/the layer thickness of the heat-conductive metal layer is from 1/1 to 6/1.

6. A fixing device comprising:

a heating device that includes a belt member that is rotated, a plurality of heating elements that are arranged in a width direction of the belt member and that generate heat so as to heat the belt member, a plurality of resistance elements that have positive temperature coefficients and that are connected to the plurality of heating elements such that each of the plurality of resistance elements is connected in series with a corresponding one of the plurality of heating elements, and a base material that includes a heat-conductive metal layer and a pair of heat-resistant metal layers between which the heat-conductive metal layer is interposed and that has a surface on which the plurality of heating elements and the plurality of resistance elements are disposed; and a pressure member that is in contact with the belt member heated by the plurality of heating elements so as to form a nip portion by which a plurality of types of recording media, which have different sizes in the width direction, are nipped, wherein a temperature of the belt member is reduced by an increase in resistances of the plurality of resistance elements caused by an increase in temperatures of the plurality of resistance elements, and wherein at least one of the plurality of heating elements and at least one of the plurality of resistance elements are disposed at respective positions corresponding to a non-pass-through range, through which a type of recording media having a smallest size out of the plurality of types of recording media nipped by the nip portion does not pass, in a width direction of the belt member.

7. An image forming apparatus comprising:

a fixing device that includes a belt member that is rotated, a plurality of heating elements that are arranged in a width direction of the belt member and that generate heat so as to heat the belt member, a plurality of resistance elements that have positive temperature coefficients and that are connected to the plurality of heating elements such that each of the plurality of resistance elements is connected in series with a corresponding one of the plurality of heating elements, and a base material that includes a heat-conductive metal layer and a pair of heat-resistant metal layers between which the heat-conductive metal layer is interposed and that has a surface on which the plurality of heating elements and the plurality of resistance elements are disposed; and a transport unit that transports a plurality of types of recording media, which have different sizes in the width direction, toward the fixing device, wherein a temperature of the belt member is reduced by an increase in resistances of the plurality of resistance elements caused by an increase in temperatures of the plurality of resistance elements, and wherein at least one of the plurality of heating elements and at least one of the plurality of resistance elements are disposed at respective positions corresponding to a non-pass-through range, through which a type of recording media having a smallest size out of the plurality of types of recording media transported by the transport unit does not pass, in a width direction of the belt member.

8. A heating device comprising:

a heating element that generates heat so as to heat an object to be heated; and a base material that includes a heat-conductive metal layer and a pair of heat-resistant metal layers between which the heat-conductive metal layer is interposed and that has a surface on which the heating element is disposed.

9. The heating device according to claim 8, wherein the heat-conductive metal layer is one of a copper layer, an aluminum layer, a silver layer, and a bronze (Cu—Sn) layer, and wherein each of the pair of heat-resistant metal layers is one of a stainless steel layer, a nickel layer, an Ni—Cr layer, and a titanic layer.

10. The heating device according to claim 8, wherein, in the base material, a ratio between a layer thickness of each of the pair of heat-resistant metal layers and a layer thickness of the heat-conductive metal layer represented by the layer thickness of each of the pair of heat-resistant metal layers/the layer thickness of the heat-conductive metal layer is from 1/3 to 10/1.

11. The heating device according to claim 8, wherein, in the base material, a ratio between a layer thickness of each of the pair of heat-resistant metal layers and a layer thickness of the heat-conductive metal layer represented by the layer thickness of each of the pair of heat-resistant metal layers/the layer thickness of the heat-conductive metal layer is from 1/2 to 8/1.

12. The heating device according to claim 8, wherein, in the base material, a ratio between a layer thickness of each of the pair of heat-resistant metal layers and a layer thickness of the heat-conductive metal layer represented by the layer thickness of each of the pair of heat-resistant metal layers/the layer thickness of the heat-conductive metal layer is from 1/1 to 6/1.

13. A base material for a heating device, the material comprising:

a heat-conductive metal layer; and a pair of heat-resistant metal layers between which the heat-conductive metal layer is interposed, wherein the base material has a surface, and wherein a heating element that generates heat so as to heat an object to be heated is disposed on the surface.

14. The material according to claim 13, wherein the heat-conductive metal layer is one of a copper layer, an aluminum layer, a silver layer, and a bronze (Cu—Sn) layer, and wherein each of the pair of heat-resistant metal layers is one of a stainless steel layer, a nickel layer, an Ni—Cr layer, and a titanic layer.

15. The material according to claim 13, wherein, in the base material, a ratio between a layer thickness of each of the pair of heat-resistant metal layers and a layer thickness of the heat-conductive metal layer represented by the layer thickness of each of the pair of heat-resistant metal layers/the layer thickness of the heat-conductive metal layer is from 1/3 to 10/1.

16. The material according to claim 13, wherein, in the base material, a ratio between a layer thickness of each of the pair of heat-resistant metal layers and a layer thickness of the heat-conductive metal layer represented by the layer thickness of each of the pair of heat-resistant metal layers/the layer thickness of the heat-conductive metal layer is from 1/2 to 8/1.

17. The material according to claim 13, wherein, in the base material, a ratio between a layer thickness of each of the pair of heat-resistant metal layers and a layer thickness of the heat-conductive metal layer represented by the layer thickness of each of the pair of heat-resistant metal layers/the layer thickness of the heat-conductive metal layer is from 1/1 to 6/1.

* * * * *